US009202682B2

(12) United States Patent
Kelly et al.

(10) Patent No.: US 9,202,682 B2
(45) Date of Patent: Dec. 1, 2015

(54) DEVICES AND METHODS RELATED TO FLAT GAS DISCHARGE TUBES

(71) Applicant: Bourns, Inc., Riverside, CA (US)

(72) Inventors: John Kelly, Passage West (IE); Johan Schleimann-Jensen, Danderyd (SE); Jan Heath, Temecula, CA (US); Craig Robert Shipley, Frisco, TX (US); Gordon L. Bourns, Riverside, CA (US)

(73) Assignee: Bourns, Inc., Riverside, CA (US)

( * ) Notice: Subject to any disclaimer, the term of this patent is extended or adjusted under 35 U.S.C. 154(b) by 0 days.

(21) Appl. No.: 14/186,722

(22) Filed: Feb. 21, 2014

(65) Prior Publication Data

US 2014/0239804 A1 Aug. 28, 2014

Related U.S. Application Data

(60) Provisional application No. 61/768,346, filed on Feb. 22, 2013.

(51) Int. Cl.

| | |
|---|---|
| ***H01J 17/26*** | (2012.01) |
| ***H01J 61/28*** | (2006.01) |
| ***H01J 61/30*** | (2006.01) |
| ***H01T 1/20*** | (2006.01) |
| ***H01T 1/10*** | (2006.01) |
| ***H01T 1/04*** | (2006.01) |
| ***H01T 4/12*** | (2006.01) |

(Continued)

(52) U.S. Cl.

CPC ..... *H01J 61/305* (2013.01); *H01J 61/92* (2013.01); *H01T 1/04* (2013.01); *H01T 1/10* (2013.01); *H01T 1/20* (2013.01); *H01T 4/12* (2013.01); *H01J 61/545* (2013.01)

(58) Field of Classification Search

CPC ..... H01J 61/305; H01J 61/92; H01J 61/545; H01J 17/00; H01J 2893/0059; H01T 4/12; H01T 1/04; H01T 1/10; H01T 1/20; H01T 1/08; H01T 2/02

USPC ..... 313/231.11–231.21; 362/380

See application file for complete search history.

(56) References Cited

U.S. PATENT DOCUMENTS 4,360,757 A 11/1982 Hahndorff
4,437,845 A * 3/1984 Schleimann-Jensen ..... 445/39

(Continued)

OTHER PUBLICATIONS

International Search Report and Written Opinion issued on Jun. 16, 2014 in connection with corresponding PCT Application No. PCT/US2014/017746.

(Continued)

*Primary Examiner* — Anne Hines
*Assistant Examiner* — Jose M Diaz
(74) *Attorney, Agent, or Firm* — Fernando Hale & Chang LLP

(57) ABSTRACT

Disclosed are devices and methods related to flat gas discharge tubes (GDTs). In some embodiments, a plurality of GDTs can be fabricated from an insulator plate having a first side and a second side, with the insulator plate defining a plurality of openings. Each opening can be covered by first and second electrodes on the first and second sides of the insulator plate to thereby define an enclosed gas volume configured for GDT operation. Various examples related to such GDTs, including electrode configurations, opening configurations, pre-ionization features, grouping of a GDT with another GDT or device, and packaging configurations, are disclosed.

20 Claims, 32 Drawing Sheets

(51) Int. Cl.
*H01J 61/92* (2006.01)
*H01J 61/54* (2006.01)

(56) References Cited

U.S. PATENT DOCUMENTS 4,493,003 A 1/1985 Mickelson et al.
5,491,381 A * 2/1996 Idei et al. ..... 313/589
5,566,056 A 10/1996 Chaudhry
5,744,909 A 4/1998 Amano
6,952,336 B2 * 10/2005 Werner et al. ..... 361/119
7,053,536 B1 5/2006 Boman et al.
7,282,858 B2 10/2007 Tokai et al.
7,932,673 B2 4/2011 Schleimann-Jensen et al.
2004/0066599 A1 * 4/2004 Werner et al. ..... 361/118
2006/0055500 A1 3/2006 Burke et al.
2006/0152329 A1 7/2006 Bjorsell
2009/0102377 A1 4/2009 Schleimann-Jensen et al.
2009/0296294 A1 * 12/2009 Liu ..... 361/56
2010/0156264 A1 * 6/2010 Boy et al. ..... 313/318.12
2012/0300352 A1 11/2012 de Palma et al.
2014/0327996 A1 * 11/2014 Westebbe et al. ..... 361/120

OTHER PUBLICATIONS

Tim Ardley, First Principles of a Gas Discharge Tube (GDT) Primary Protector, 2008, Bourns, Inc.
Craig Shipley, Gas Discharge Tube Protection, 2005, Bourns, Inc.

* cited by examiner

DEVICES AND METHODS RELATED TO FLAT GAS DISCHARGE TUBES

CROSS-REFERENCE TO RELATED APPLICATIONS

This application claims priority to U.S. Provisional Application No. 61/768,346 filed Feb. 22, 2013 entitled DEVICES AND METHODS RELATED TO FLAT GAS DISCHARGE TUBES, the disclosure of which is hereby expressly incorporated by reference herein in its entirety.

BACKGROUND

1. Field

The present disclosure generally relates to gas discharge tubes, and more particularly, to devices and methods related to flat gas discharge tubes.

2. Description of the Related Art

A gas discharge tube (GDT) is a device having a volume of gas confined between two electrodes. When sufficient potential difference exists between the two electrodes, the gas can ionize to provide a conductive medium to thereby yield a current in the form of an arc.

Based on such an operating principle, GDTs can be configured to provide reliable and effective protection for various applications during electrical disturbances. In some applications, GDTs can be preferable over semiconductor discharge devices due to properties such as low capacitance and low insertion/return losses. Accordingly, GDTs are frequently used in telecommunications and other applications where protection against electrical disturbances such as overvoltages is desired.

SUMMARY

In some implementations, the present disclosure relates to a device that includes an insulator plate having a first side and a second side. The insulator plate defines a plurality of openings, with each opening dimensioned to be capable of being covered by first and second electrodes on the first and second sides of the insulator plate to thereby define an enclosed gas volume configured for a gas discharge tube (GDT) operation.

In some embodiments, the insulator plate can be a ceramic plate. The insulator plate can further define a plurality of score lines on either or both of the first and second sides, with the score lines being dimensioned to facilitate singulation of the insulator plate into a plurality of individual units each having one or more openings.

In some embodiments, the device can further include the first electrode mounted to the first side and the second electrode mounted to the second side to form the enclosed gas volume. The insulator plate can have a substantially uniform thickness between the first and second sides. Each of the first and second electrodes can include an inner center surface such that the enclosed gas volume includes a cylindrical shaped volume defined by the opening and the inner center surfaces of the first and second electrodes. Each of the first and second electrodes can further include an inner recessed portion configured to allow a portion of the corresponding surface about the opening to be exposed to the cylindrical shaped volume. The device can further include one or more pre-ionization lines implemented on the surface about the opening exposed by the inner recessed portion of the electrode. The one or more pre-ionization lines can be configured to reduce a response time during the GDT operation.

In some implementations, the present disclosure relates to a method for fabricating an insulator for a plurality of gas discharge tubes (GDTs). The method includes providing or forming an insulator plate having a first side and a second side. The method further includes forming a plurality of openings on the insulator plate, with each opening being dimensioned to be capable of being covered by first and second electrodes on the first and second sides of the insulator plate to thereby define an enclosed gas volume configured for a gas discharge tube (GDT) operation.

In some embodiments, the method can further include forming a plurality of score lines on either or both of the first and second sides. The score lines can be dimensioned to facilitate singulation of the insulator plate into a plurality of individual units each having one or more openings.

In some implementations, the present disclosure relates to a method for fabricating gas discharge tube (GDT) devices. The method includes providing or forming an insulator plate having a first side and a second side. The method further includes forming a plurality of openings on the insulator plate. The method further includes covering each opening with first and second electrodes on the first and second sides of the insulator plate to thereby define an enclosed gas volume.

In some embodiments, the method can further include forming a plurality of score lines on either or both of the first and second sides. The score lines can be dimensioned to facilitate singulation of the insulator plate into a plurality of individual units each having one or more openings. The method can further include singulating the insulator plate into the plurality of individual units. The method can further include packaging the singulated individual units into a desired form. The desired form can include a surface mount form.

In some embodiments, the forming of the plurality of openings can include forming an internal insulator ring having an inner boundary defined by the opening and an outer boundary. The internal insulator can have a reduced thickness between the inner and outer boundaries. The reduced thickness can have a value that is less than a thickness between the first and second sides. The internal insulator ring can be dimensioned to provide an extended pathlength for creeping current.

In some embodiments, the method can further include forming or providing a joint layer that facilitates the covering of the openings with their respective electrodes. The joint layer can include a metallization layer formed around each of the openings on the first and second sides of the insulator plate. The joint layer can further include a brazing layer for joining the electrode to the metallization layer. The brazing layer can be, for example, a brazing washer, and such a brazing washer can be a part of an array of brazing washers joined together. The brazing layer can be, in another example, formed by printing a brazing paste.

In some implementations, the present disclosure relates to a gas discharge tube (GDT) device that includes an insulator layer having first and second sides and a polygon shape with a plurality of edges. The insulator layer includes a score feature along at least one of the edges. The insulator layer defines one or more openings. The GDT device further includes first and second electrodes disposed on the first and second sides of the insulator layer, respectively, so as to cover each of the one or more openings to thereby define an enclosed gas volume.

In some embodiments, the insulator layer can include a ceramic layer. In some embodiments, the polygon can be a rectangle. The insulator layer can define an internal insulator ring having an inner boundary defined by the opening and an outer boundary. The internal insulator can have a reduced thickness between the inner and outer boundaries. The reduced thickness can have a value that is less than a thickness between the first and second sides. The internal insulator ring can be dimensioned to provide an extended pathlength for creeping current.

In some embodiments, the GDT device can further include a joint layer disposed between each of the first and second electrodes and their respective surfaces on the first and second sides. The joint layer can include a metallization layer formed around each of the openings on the first and second sides of the ceramic layer. The joint layer can further include a brazing layer configured to facilitate joining of the electrode to the metallization layer. The brazing layer can include, for example, a brazing washer. The brazing washer can include at least one severed portion of a joining tab that held the brazing washer with one or more other brazing washers. The brazing layer can include, in another example, a printed brazing paste.

In some embodiments, each of the first and second electrodes can have a circular shape with an inner side and an outer side, with the inner side defining a shape dimensioned to facilitate the shape and/or functionality associated with the ceramic layer around the opening. The ceramic layer around the opening can include a plurality of pre-ionization lines. The inner surface of the electrode can be recessed to provide a space around the pre-ionization lines.

In some embodiments, the insulator layer can have a substantially uniform thickness between the first and second sides. The GDT device can further include a joint layer disposed between each of the first and second electrodes and their respective surfaces on the first and second sides. The joint layer can include a metallization layer formed around each of the openings on the first and second sides of the ceramic layer. The joint layer can further include a brazing layer configured to facilitate joining of the electrode to the metallization layer. The brazing layer can include, for example, a brazing washer. The brazing washer can include at least one severed portion of a joining tab that held the brazing washer with one or more other brazing washers. The brazing layer can include, in another example, a printed brazing paste.

In some embodiments, each of the first and second electrodes can include an inner center surface such that the enclosed gas volume includes a cylindrical shaped volume defined by the opening and the inner center surfaces of the first and second electrodes. The inner surface can include a plurality of concentric features configured to assist in adhesion of a coating layer on the electrode. Each of the first and second electrodes can further include an inner recessed portion configured to allow a portion of the corresponding surface about the opening to be exposed to the cylindrical shaped volume. The GDT device can further include one or more pre-ionization lines implemented on the surface about the opening exposed by the inner recessed portion of the electrode. Each of the one or more pre-ionization lines can be configured to reduce a response time of the GDT device and therefore lower a corresponding impulse-spark-over voltage. The pre-ionization line can include graphite, graphene, aqueous forms of carbon, or carbon nanotubes.

In some embodiments, the ceramic layer can define one opening to thereby yield a single gas discharge volume. In some embodiments, the ceramic layer can define a plurality of openings to thereby yield a plurality of gas discharge volumes. The plurality of openings can be arranged in a single row. The first electrodes associated with the plurality of openings can be electrically connected, and the second electrodes associated with the plurality of openings can be electrically connected.

In some embodiments, the GDT device can further include one or more packaging features configured to package the assembly of ceramic layer and the electrodes in a surface mount form. The surface mount form can include a DO-214AA format, an SMD 2920 format, or a pocket packaging format.

In some embodiments, the GDT device can further include a packaging substrate that defines a first recess such as a pocket dimensioned to receive the assembly of ceramic layer and the electrodes. The packaging substrate can further define an additional recess dimensioned to receive an electrical component. The electrical component can include a gas discharge tube, a multifuse polymeric or ceramic PTC device, an electronic current-limiting device, a diode, a diode bridge or array, an inductor, a transformer, or a resistor.

In some implementations, the present disclosure relates to a packaged electrical device that includes a packaging substrate that defines a recess such as a pocket. The packaged electrical device further includes a gas discharge tube (GDT) positioned at least partially within the recess. The GDT includes an insulator layer having first and second sides defining an opening. The GDT further includes first and second electrodes disposed on the first and second sides of the insulator layer, respectively, so as to cover the opening to thereby define an enclosed gas volume. The packaged electrical device further includes first and second insulator layers positioned on first and second sides of the GDT so as to at least partially cover the first and second electrodes, respectively. The packaged electrical device further includes first and second terminals, with each of the first and second terminals being disposed on either or both of the first and second insulator layers. The first and second terminals are electrically connected to the first and second electrodes, respectively.

In some embodiments, each of the first and second terminals can be disposed on both of the first and second insulator layers. Each of the first and second terminals can include metal layers formed on each of the first and second insulator layers and electrically connected to each other. The metal layers on the first and second insulator layers can be electrically connected by a conductive via. The metal layer on the first insulator layer can be electrically connected to the first electrode by a micro-via formed through the first insulator layer, and the metal layer on the second insulator layer can be electrically connected to the second electrode by a micro-via formed through the second insulator layer. The first electrode can be electrically connected to the first terminal by a first conductive feature that extends laterally from the first electrode to the first conductive via, and the second electrode can be electrically connected to the second terminal by a second conductive feature that extends laterally from the second electrode to the second conductive via. Each of the first conductive feature and the second conductive feature can be attached to or be an extension of the respective electrode when a plurality of the packaged electrical device are being fabricated in an array.

For purposes of summarizing the disclosure, certain aspects, advantages and novel features of the inventions have been described herein. It is to be understood that not necessarily all such advantages may be achieved in accordance with any particular embodiment of the invention. Thus, the invention may be embodied or carried out in a manner that achieves or optimizes one advantage or group of advantages as taught herein without necessarily achieving other advantages as may be taught or suggested herein.

DETAILED DESCRIPTION OF SOME EMBODIMENTS

The headings provided herein, if any, are for convenience only and do not necessarily affect the scope or meaning of the claimed invention.

Traditional gas discharge tubes (GDTs) are typically made using cylindrical tubes of electrically-insulating material such as ceramic. Such tubes are filled with gas and sealed using circular metal electrode caps on each end. More recently, flat GDTs have been developed. Examples of such GDTs are described in greater detail in U.S. Pat. No. 7,932,673, which is expressly incorporated by reference in its entirely.

Described herein are devices and methods related to flat GDTs that can be fabricated as discrete devices, as an array of multiple devices, in combination with active devices, passive devices or combination of devices in a single package, an array or a module, or any combination thereof. As described herein, such fabrication technologies can be complemented with various processes such as deposition and manufacturing processes to yield advantageous features such as high throughput, lower per-unit cost, automation, improved quality, reduced size, desirable form factors, ability to integrate with other components, and improved long-term reliability.

Figure 1A:
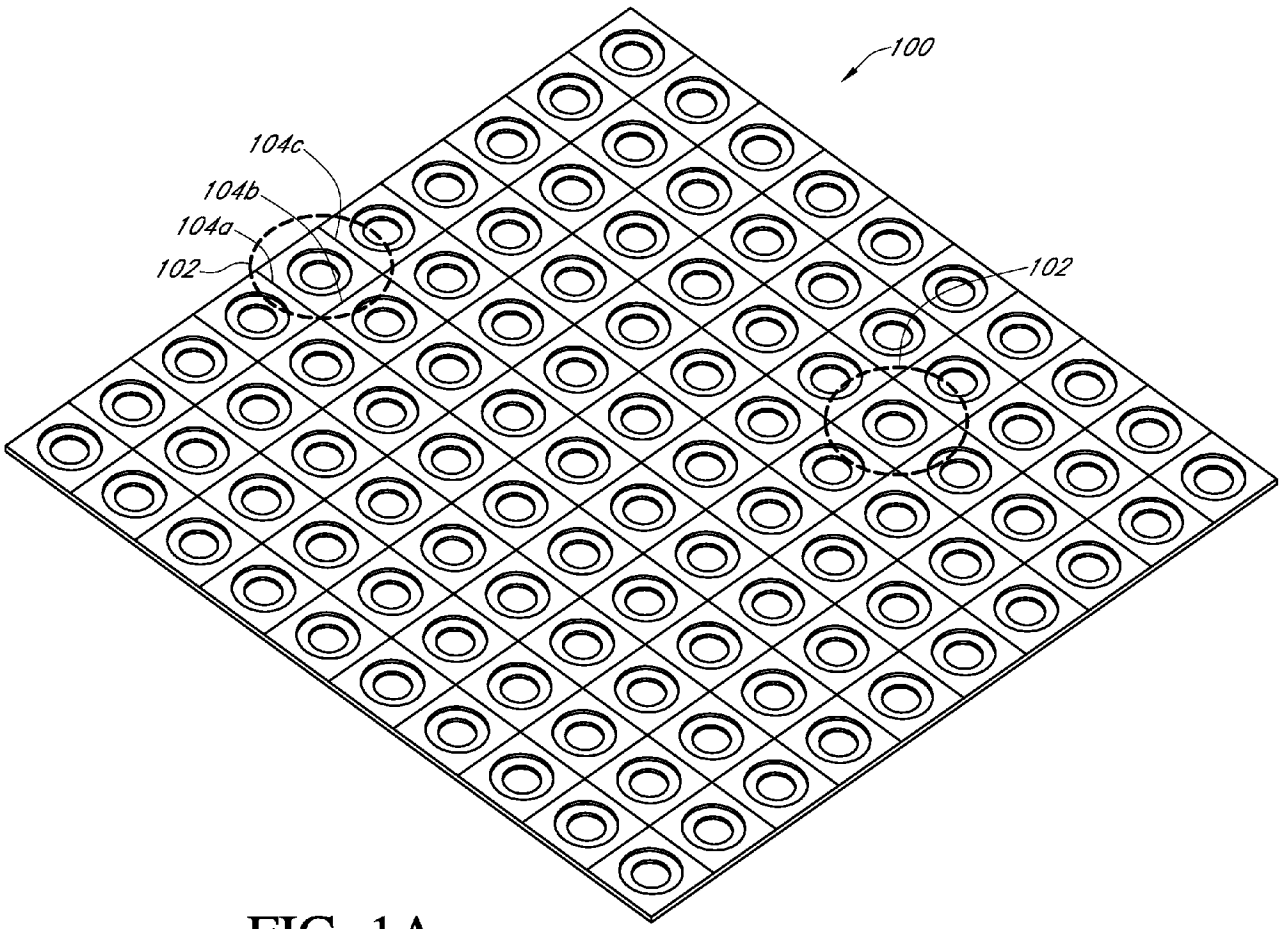
FIGS. 1A and 1B show an example array of flat gas discharge tubes (GDTs) in different stages of fabrication.
Figure 1B:
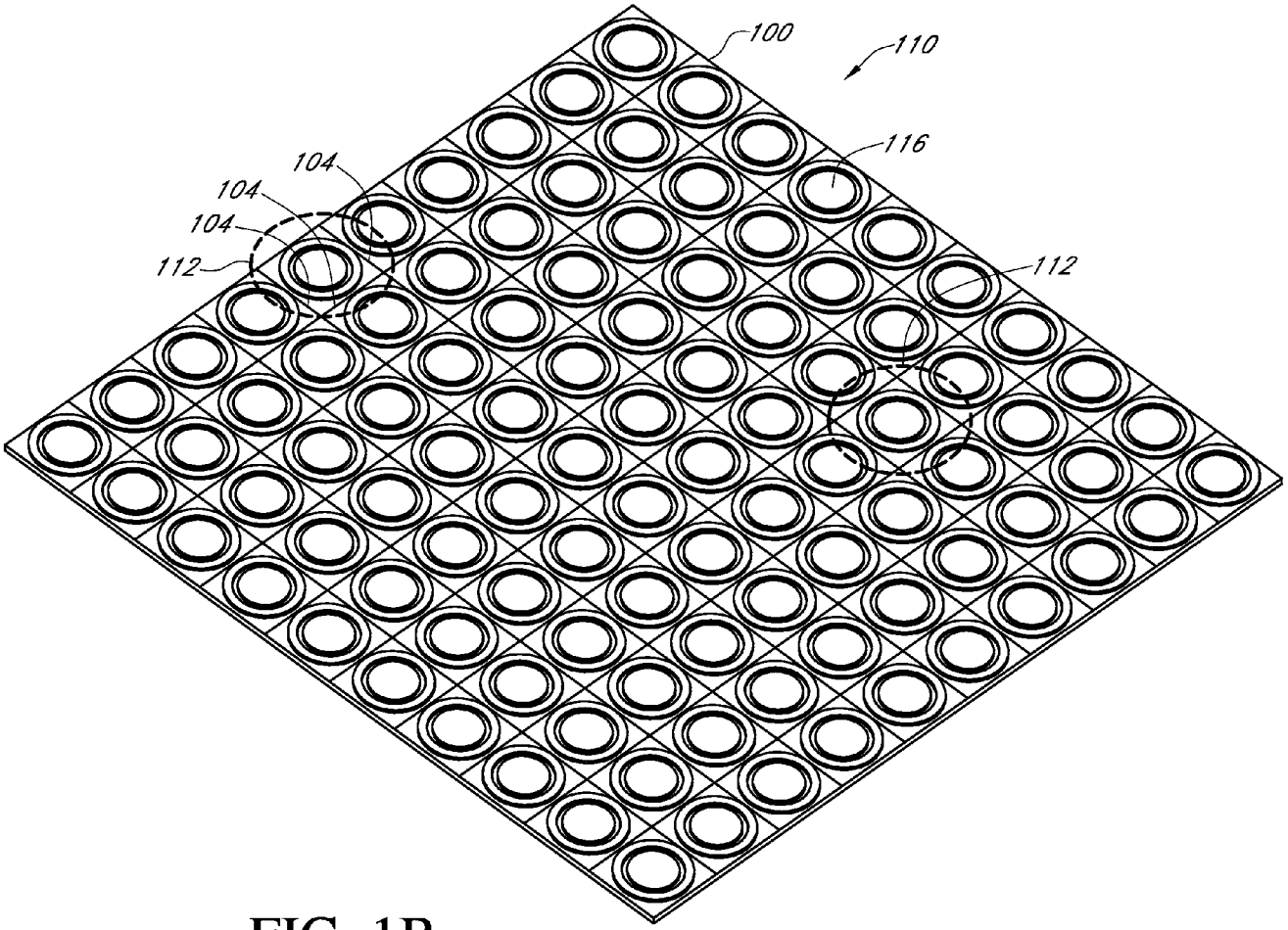

FIGS. 1A and 1B show that in some implementations, an array of GDTs can be fabricated together and be separated into individual units. By undergoing various fabrication steps together, the resulting devices as well as the manufacturing process can benefit from one or more of the foregoing advantageous features. In FIG. 1A, an example insulator plate such as a ceramic plate 100 is shown to include a plurality of individual insulator structures 102. Although described in the context of ceramic materials, it will be understood that one or more features of the present disclosure can also be implemented in other types of insulating materials suitable for use in GDTs.

The example ceramic plate 100 is shown to include a plurality of score lines 104 formed on the ceramic plate 100 to facilitate separation (also referred to herein as singulation) of the individual devices based on the insulator structures 102. Such singulation can be performed after completion of individual GDTs including, assembly, plating, conditioning, marking and testing, after partial assembly of individual GDTs, at any stage of manufacturing the GDT or prior to assembly of individual GDTs. In the example shown, an insulator structure 102 on an edge of the plate 100 is shown to have score lines 104*a*-104*c* that define the example square shape of the structure 102.

In FIG. 1A, each of the insulator structures 102 is shown to include a circular structure that defines an opening. Various non-limiting examples of such circular structures are described herein in greater detail.

In some implementations, the score lines 104 and the circular structures can be formed prior to firing (e.g., in a green-state) by, for example, mechanical or laser drilling, or by using devices such as a cookie-cutter, punches or progressive punches. The score lines 104 and the circular structures can also be formed after firing using, for example, mechanical or laser drilling of holes and formation of score lines.

FIG. 1B shows an array 110 of generally completed GDTs 112 formed on the ceramic plate 100 of FIG. 1A. In the example shown, the GDTs have not been singulated yet; and such singulation can be facilitated by the score lines 104. Each GDT 112 is shown to include electrodes 116 (upper one shown, lower one hidden from view). Examples of such electrodes and how they can be mounted to the ceramic plate are described herein in greater detail.

FIGS. 2 and 3 show side sectional and plan views of an example individual GDT being fabricated. FIGS. 2A and 3A show a side sectional view and a plan view, respectively, of an individual insulator structure 102 still joined to one or more neighboring structures in a ceramic plate 100. As described herein, score lines 104 can be configured to facilitate singulation of the individual GDT corresponding to the insulator structure 102.

The insulator structure 102 can define a first surface 120*a* (e.g., upper surface) and a second surface 120*b* (e.g., lower surface) opposite the first surface 120*a*. In some embodiments, when electrodes (not shown in FIGS. 2A and 3A) are mounted to the insulator structure 102, at least a portion of the insulator structure 102 that defines the upper and lower surfaces 120*a*, 120*b* can act as an external insulating ring for the GDT.

Figure 2A:
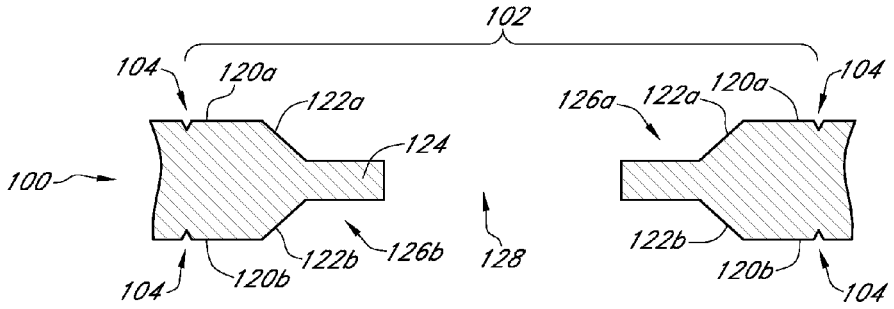
FIGS. 2A-2D' show side sectional views of an example flat GDT at different stages of fabrication.
Figure 3A:
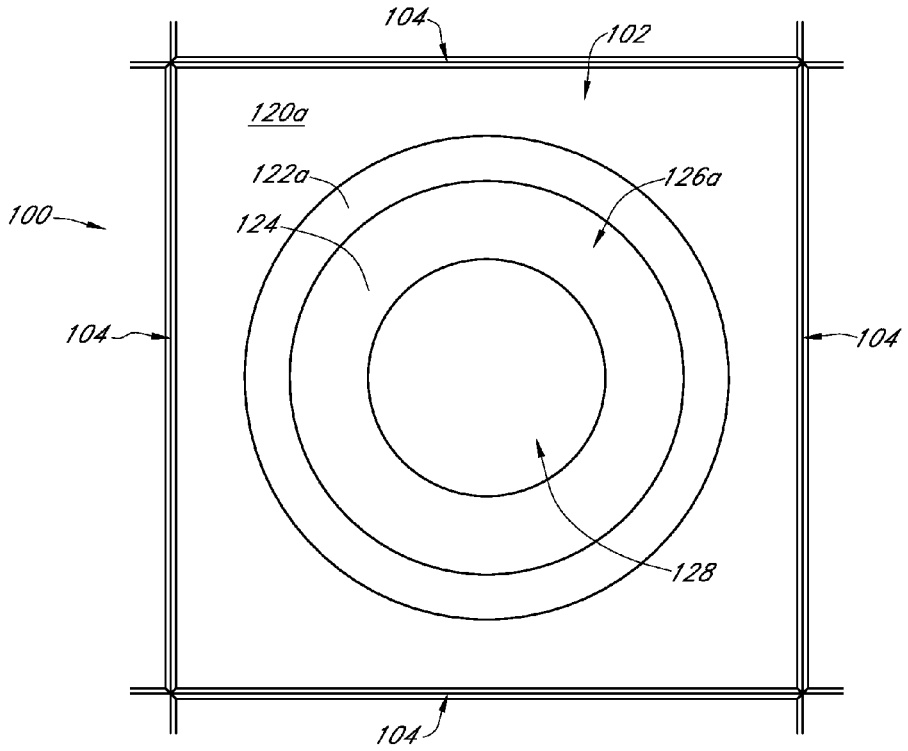
FIGS. 3A-3D' show plan views of the example flat GDT of FIGS. 2A-2D'.
Figure 2B:
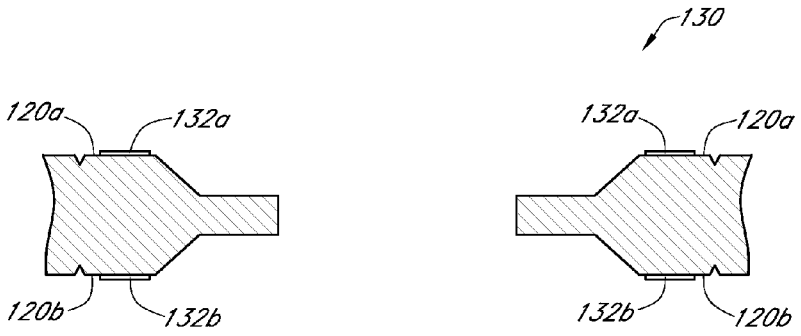

FIGS. 2A and 3A show that in some embodiments, the insulator structure 102 can include an internal insulating ring 124 that extends radially inward from the external insulating ring. As shown, the internal insulating ring 124 can have a thickness that is less than the thickness of the external insulating ring (e.g., between the upper and lower surfaces 120*a*, 120*b*). Upper and lower angled surfaces 122*a*, 122*b* can facilitate the transition of the different thicknesses of the external and internal insulating rings, thereby defining an upper cavity 126*a* and a lower cavity 126*b*.

FIGS. 2A and 3A further show that the inner boundary of the internal insulating ring 124 defines and provides an opening 128 between the upper and lower cavities 126*a*, 126*b*. As generally understood, the presence of the internal insulating ring 124 can provide an extended length for a creeping current to thereby allow improved management of the same. In some embodiments, similar functionality can be achieved by a shaped electrode profile (e.g., shaped electrodes and a flat insulator structure in FIG. 6B). In some embodiments, both of the electrode and the insulator structure can be dimensioned appropriately to achieve the foregoing functionality.

Although the example creeping current management (e.g., reduction) functionality shown in FIGS. 2A and 3A is in the context of the internal insulator ring 124 having a desired shape, it will be understood that an outer portion of the insulator structure 102 can also shaped to provide such functionality. In the context of the example square boundary of the example insulator structure 102 of FIGS. 2A and 3A, the boundary edges being spaced from the radial location where electrodes end can provide at least some of such creeping current reduction functionality. In some embodiments, the boundary portions of the insulator structure 102 can be shaped further (e.g., a reduced-thickness boundary) to provide additional creeping current control functionality.

FIGS. 2B-2D and 3B-3D show an example of how electrodes can be mounted to the upper and lower surfaces 120*a*, 120*b* of the insulator structure 102. In a configuration 130 of FIGS. 2B and 3B, a metallization layer 132 is shown to be formed on each of the upper and lower surfaces 120*a*, 120*b*. Such metallization layers can facilitate mounting of the electrodes onto the insulator structure 102.

Figure 3B:
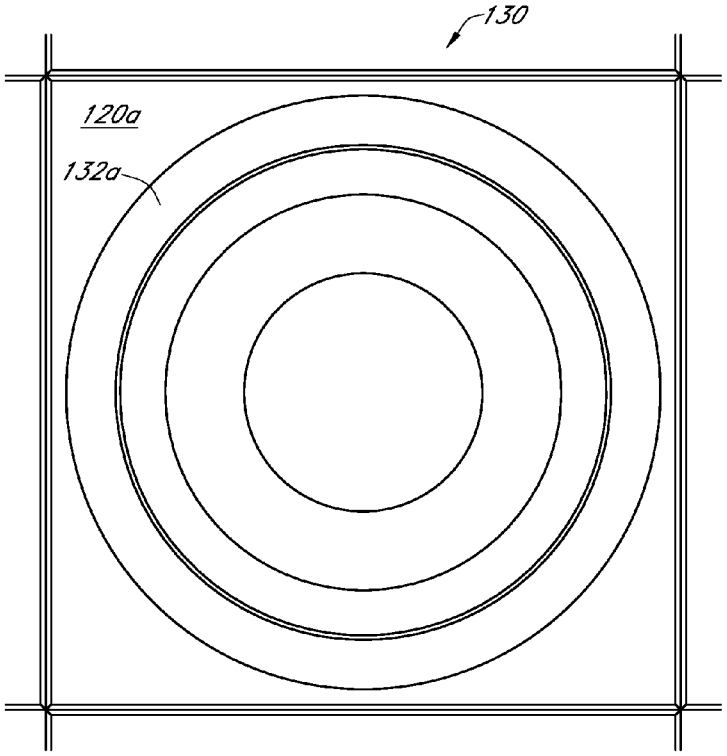

As shown in FIG. 3B, each of the metallization layers 132*a*, 132*b* can have a ring shape in a plan view. The metallization layers 132*a*, 132*b* can be formed by, for example, transfer printing, screen printing or spraying on with or without a stencil. Such a metal layer can include materials such as tungsten, tungsten-manganese, molybdenum-manganese, or other suitable materials. Such a metal layer can have a thickness in a range of, for example, about 0.4-1.4 mil (about 10-35 μm). Other thickness ranges or values can also be implemented.

In some implementations, active brazing can be utilized. In such a configuration, metallization may not be required, and electrodes can be bonded directly to the ceramic insulator structure 102 to form a gas seal.

Figure 2C:
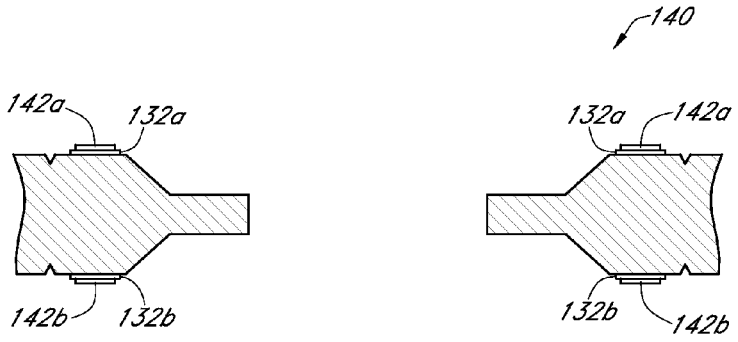
Figure 3C:
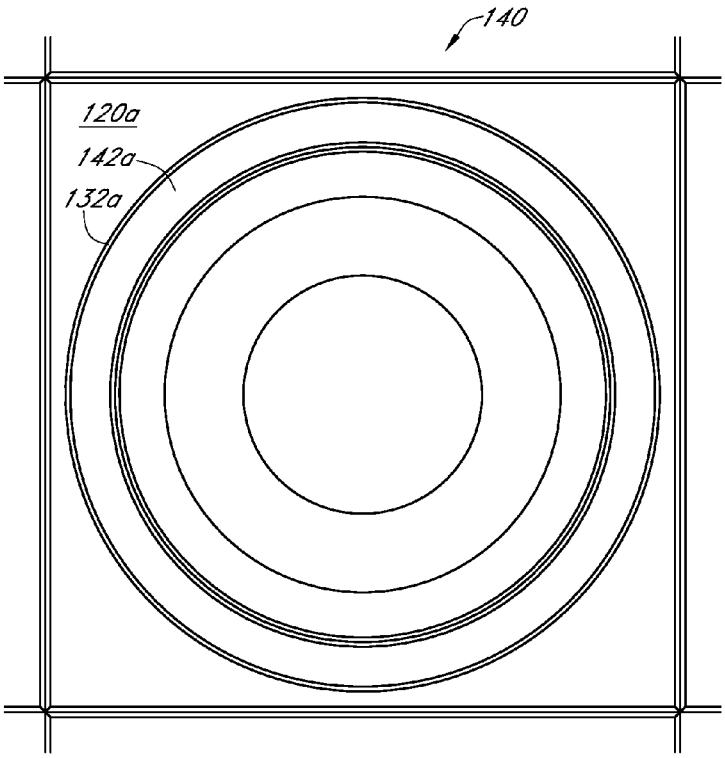

In a configuration 140 of FIGS. 2C and 3C, a joining layer 142 is shown to be formed on each of the metalized rings 132*a*, 132*b* on the upper and lower surfaces 120*a*, 120*b*. In some embodiments, the joining layer 142 can include, for example brazing material. Examples of how such brazing material can be implemented are described herein in greater detail. Such brazing layers can facilitate securing of the electrodes onto the metalized rings 132*a*, 132*b*.

As shown in FIG. 3C, each of the brazing layers 142*a*, 142*b* can have a ring shape in a plan view. In some implementations, the brazing layers 142*a*, 142*b* can be formed by, for example, a brazing paste utilizing application techniques such as printing. When applied in such a manner, the brazing layer 142 can have a thickness in a range of, for example, about 2-10 mil (about 50.8 μm-254 μm). Other thickness ranges or values can also be implemented.

In some implementations, the brazing layers 142*a*, 142*b* can be in the form of brazing washers. Such washers can be in individual units, or be joined in an array configured to substantially match the dimensions of the array of insulator structures 102. An example such an array of brazing washers is described herein in greater detail.

Figure 2D:
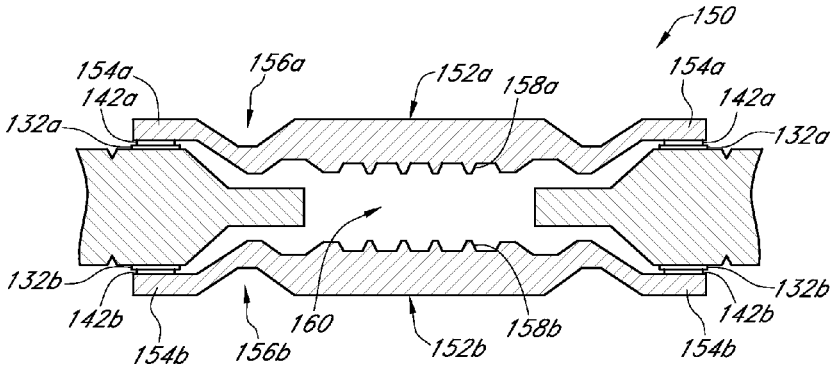
Figure 3D:
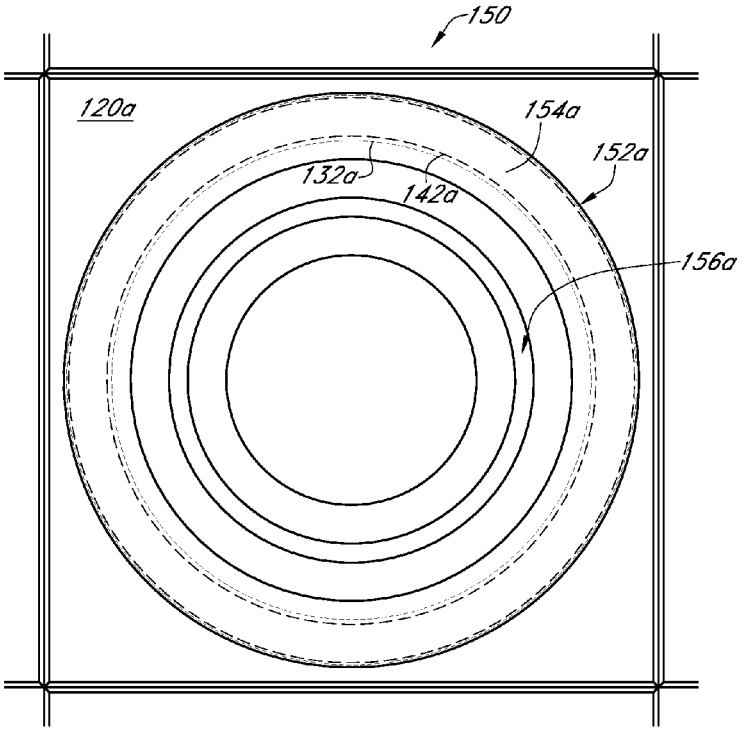
Figure 2D:
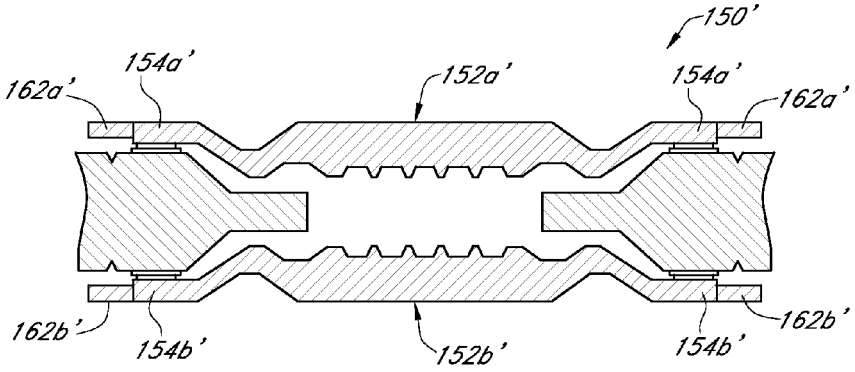
Figure 3D:
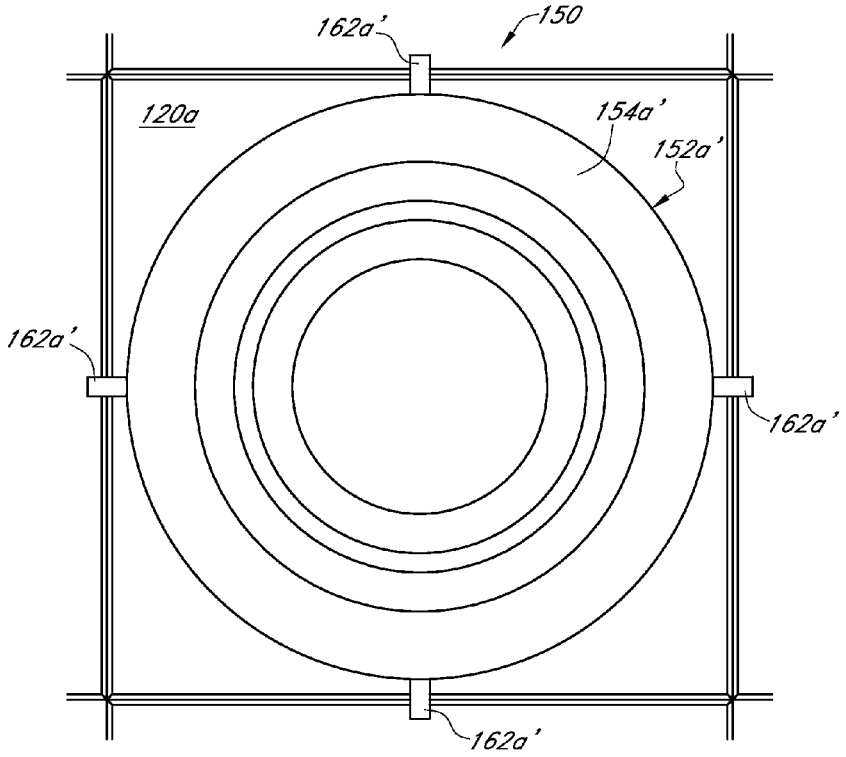

In an example configuration 150 of FIGS. 2D and 3D, an electrode 152 is shown to be secured to each side of the insulator structure 102 with the brazing layers 142*a*, 142*b* and the metalized rings 132*a*, 132*b*. Such brazing can be achieved by, for example, positioning the electrodes 152*a*, 152*b* against the brazing layers 142*a*, 142*b* and heating the assembly (e.g., in a range of about 1292-1652° F. (700-900° C.)).

As shown in FIGS. 2D and 3D, each of the example electrodes 152*a*, 152*b* can have a circular disk shape. The disk can include a perimeter portion 154 dimensioned to generally mate with the respective brazing layer 142.

In some embodiments, the disk-shaped electrode 152 can further define one or more features to provide one or more functionalities. For example, the inner side of the disk can be dimensioned to generally match the sloped wall (122 in FIG. 2A) of the cavity 126. Radially inward, the inner side of the disk can define a plurality of concentric circular features or cavities 158 configured to, for example, assist in the adhesion of electrode-coatings for protecting the electrodes and thus increasing the life expectancy of the GDT.

The outer side of the disk-shaped electrode 152 can be dimensioned to, for example, define a center contact pad. In the example shown, an annular recess 156 is shown to form an island feature where an electrical contact can be made. The annular recess 156 can be configured to provide strain relief to the ceramic as well as the seal joint to better withstand mechanical strain caused by the differences in expansion coefficients of the electrodes 152*a*, 152*b* and the ceramic insulator structure.

As shown in FIG. 2D, securing the upper and lower electrodes 152*a*, 152*b* on the upper and lower sides of the insulator structure 102 yields an enclosed volume 160 that can be filled with desired gas. Combined with the electrode configuration and the internal insulating ring (124 in FIG. 2A), the gas volume 160 can provide a desired discharge property.

Figure 4A:
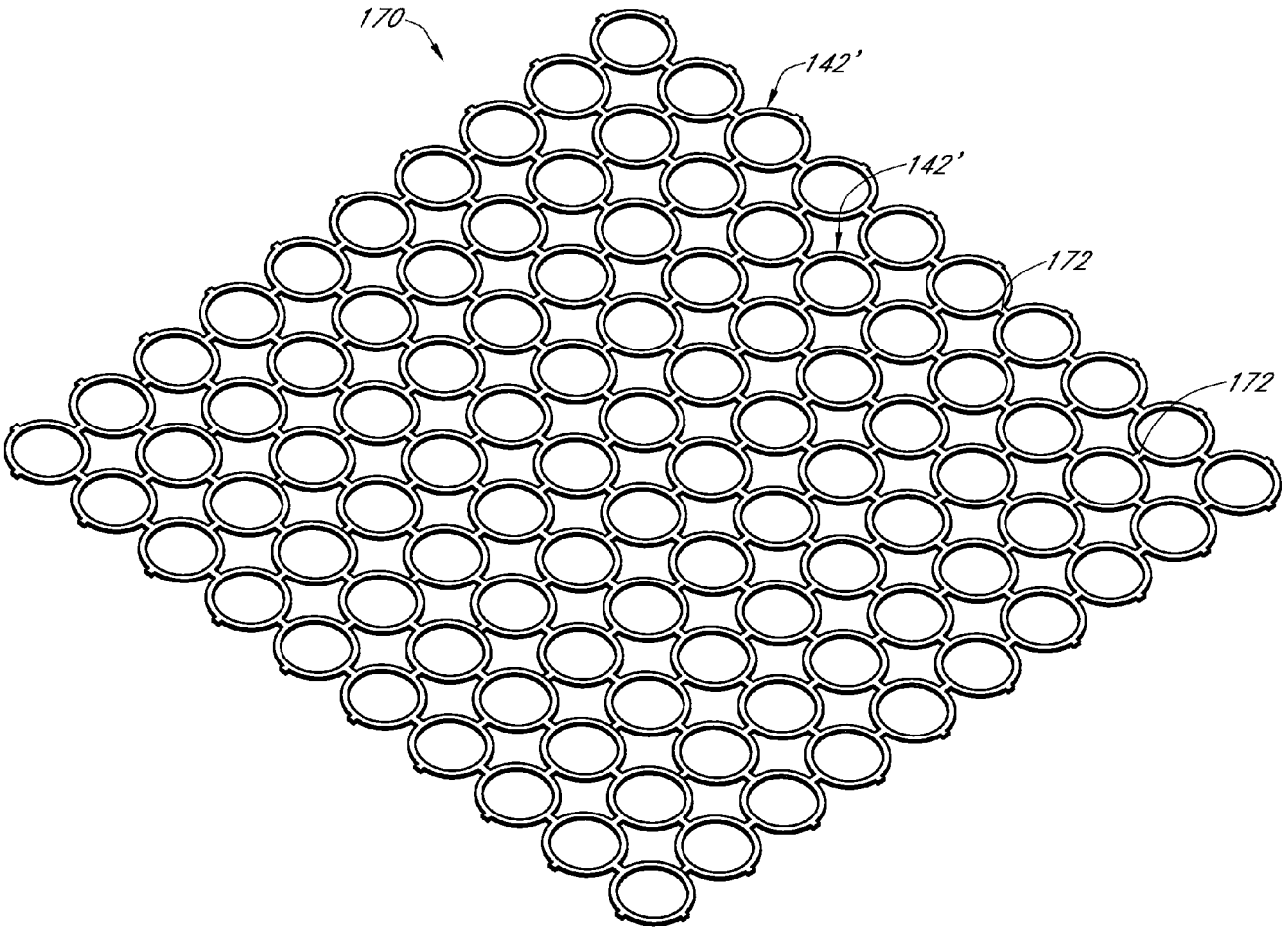
FIG. 4A shows an example array of brazing rings that can be utilized to facilitate mounting of electrodes onto an array of insulator structures.
Figure 4B:
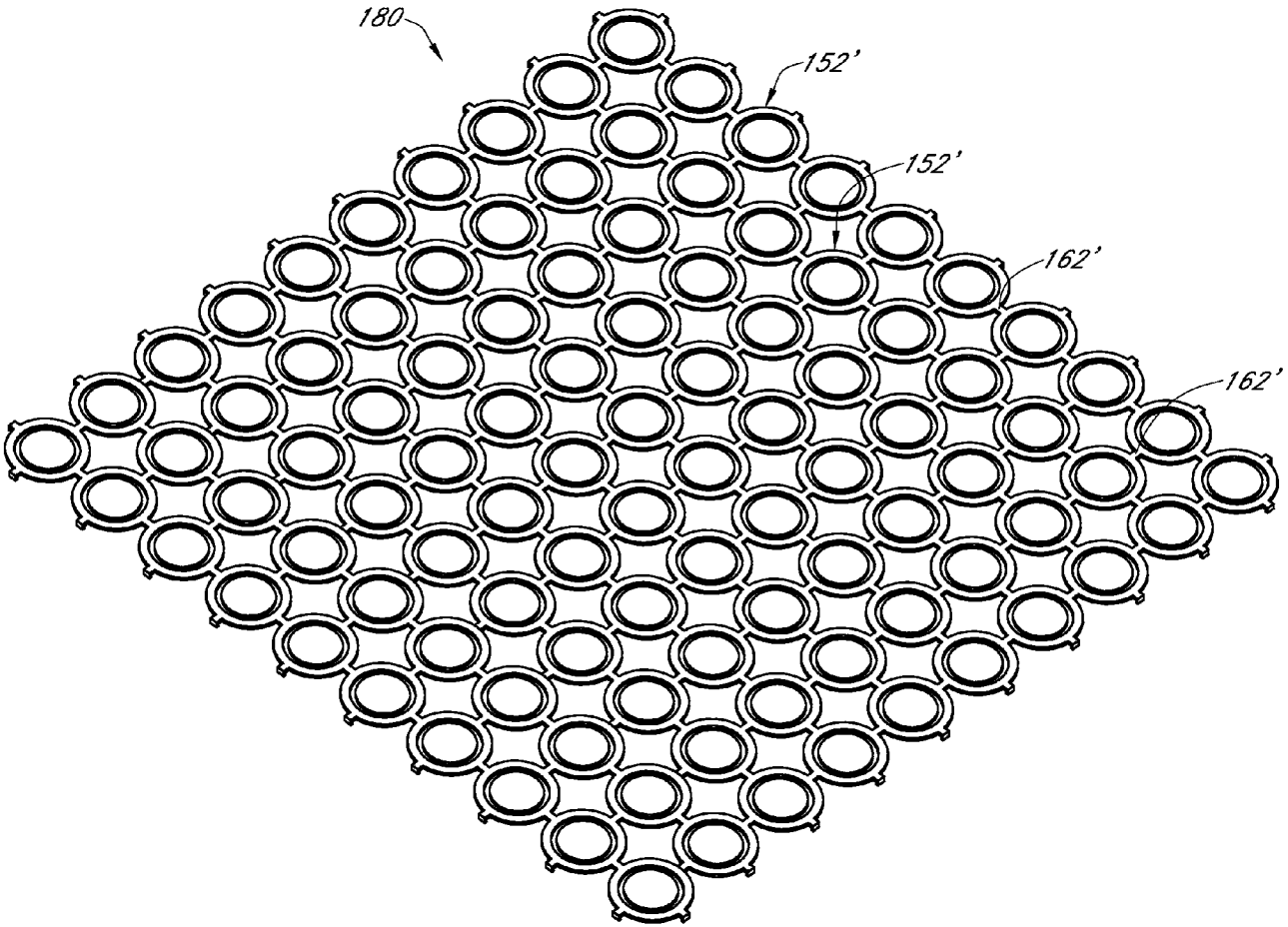
FIG. 4B shows an example array of electrodes that can be mounted onto an array of insulator structures.

FIGS. 2D' and 3D' show an example configuration 150' where each of the electrodes 152*a*', 152*b*' can be part of an array of such electrodes still joined together when secured to the insulator structure 102. An example of such an array of electrodes is shown in FIG. 4B as an array 180 having a plurality of individual electrodes 152' joined by tabs 162' through perimeter portions 154' of the electrodes 152'. In FIGS. 2D' and 3D', the joining tabs for the electrodes 152*a*' and 152*b*' are respectively depicted as 162*a*' and 162*b*'.

In some implementations, each of the brazing layers 142 can be a preformed ring dimensioned to facilitate the brazing of the electrode 152 and/or 152' to the insulator structure 102. Such brazing rings can be in individual pieces, or be joined together in an array similar to the example array of electrodes in FIG. 4B. FIG. 4A shows and example array 170 of brazing rings 142' that are still joined together when applied to their respective metallization layers on the insulator structure. In FIG. 4A, tabs that join brazing rings are depicted as 172. In the context of such joined brazing rings, the example configuration in FIGS. 2D' and 3D' can include joining tabs for the brazing rings similar to those for the electrodes 152'

Figure 4C:
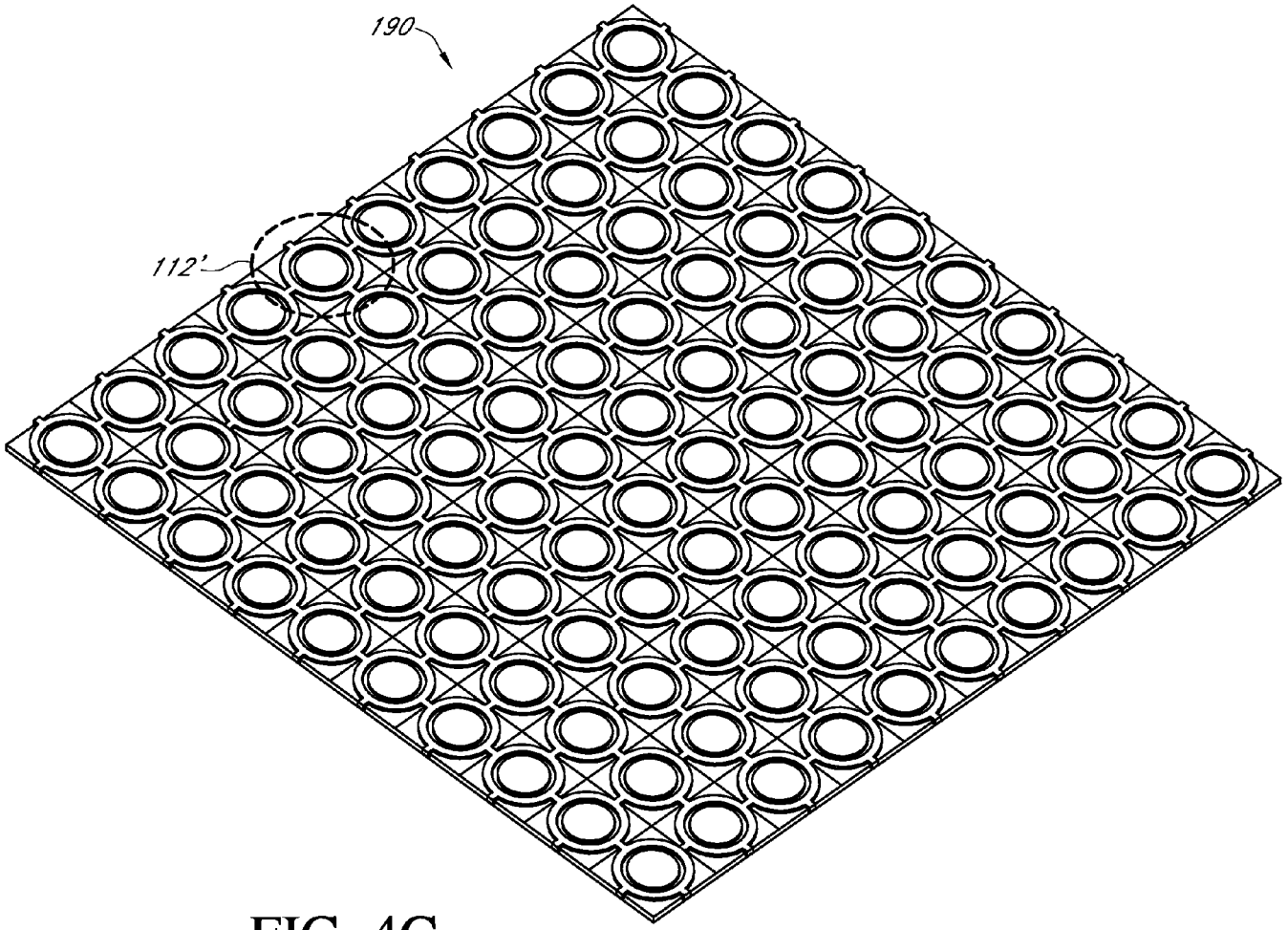
FIG. 4C shows an example configuration where the array of electrodes of FIG. 4B has been mounted to an array of insulator structures so as to form an array of GDTs.

FIG. 4C shows an example configuration 190 where the array of electrodes 180 of FIG. 4B has been mounted to an array of insulator structures so as to form an array of GDTs 112'. As described herein, brazing layers such as printed brazing paste or an array of brazing rings (170 in FIG. 4A) can be utilized to facilitate such mounting of the electrodes.

The assembled array of GDTs 112' can be singulated into individual pieces in a number of ways. For example, the joining tabs (162' in FIG. 4B) of the array of electrodes 180 can be sawed off, and the insulator structures can be sawed apart or snapped apart facilitated by the score lines.

Figure 5:
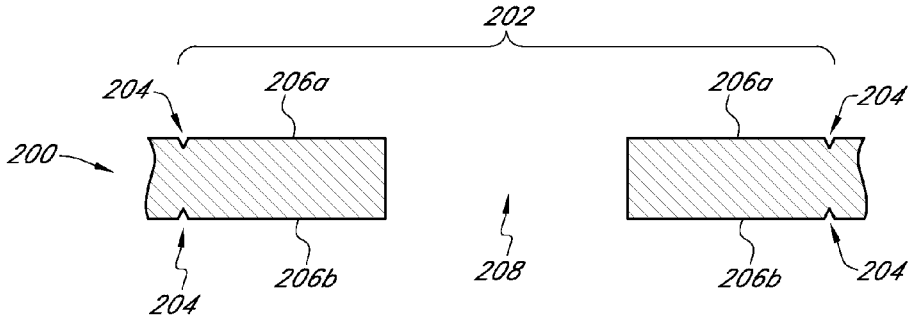
FIG. 5 shows an example insulator structure having a generally flat structure.

FIGS. 5 and 6 show various non-limiting examples of other configurations that can be implemented for insulator structures and/or electrodes. FIG. 5 shows an example insulator structure 202 having a generally flat structure. The individual insulator structure 202 can be a part of a plate 200 (e.g., a ceramic plate) having an array of such insulator structures. Each insulator structure 202 is shown to define a first surface 206*a* (e.g., an upper surface) and a second surface 206*b* (e.g., a lower surface). Score lines 204 can be formed in a manner similar to the example described in reference to FIGS. 1, 2 and 3, to facilitate the singulation of the individual insulator structures 202.

The example flat ceramic insulator structure 202 is shown to be generally free of forming or moulding features, and simply defines an aperture 208 between the upper and lower surfaces 206*a*, 206*b*. Such a structure can facilitate or provide a number of desirable features. For example, flat surfaces associated with the example insulator structure 202 can allow easier formation (e.g., printing) of pre-ionization lines. An example of such pre-ionization lines is described herein in greater detail. In other examples, the relatively simpler structure of the insulator structure 202 can provide desirable features such as a capability for larger multi-up plates, better flatness control, use of simpler tools for forming of the apertures 208, and generally simpler fabrication processes.

Figure 6A:
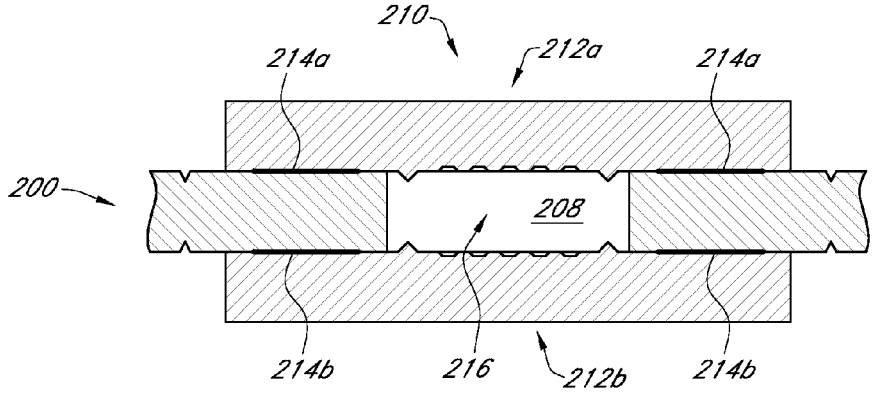
FIG. 6A shows an example GDT configuration having the example flat insulator of FIG. 5 and relatively simple electrodes.

FIG. 6A shows an example GDT configuration 210 having the flat ceramic insulator structure 202 of FIG. 5 and relatively simple electrodes 212*a*, 212*b*. An individual insulator structure corresponding to the GDT 210 can be a part of a plate 200 (e.g., a ceramic plate), to be singulated later. The electrodes 212*a*, 212*b* are shown to be mounted to the upper and lower surfaces of the flat ceramic insulator 202 utilizing joints 214*a*, 214*b*. Each of the joints 214*a*, 214*b* can include a metallization layer and a brazing layer as described herein.

FIG. 6A further shows that when the electrodes 212*a*, 212*b* are secured to the flat ceramic insulator 202, the opening 208 between the upper and lower surface of the flat ceramic insulator now becomes substantially enclosed by the electrodes to thereby define an enclosed volume 216. Such an enclosed volume can be filled with gas to provide a desired discharge property.

The relatively simpler configuration of the example GDT 210 of FIG. 6A can benefit from a number of desirable features. For example, the resulting GDT can be relatively small, and can be manufactured with lower cost.

The example GDT 210 as depicted in FIG. 6A does not have pre-ionization lines. However, for applications where better impulse performance is required or desired, ionization lines can be applied to, for example, the inside of the opening (208 in FIG. 5) (e.g., on the vertical surface) of the ceramic structure 202.

Figure 6B:
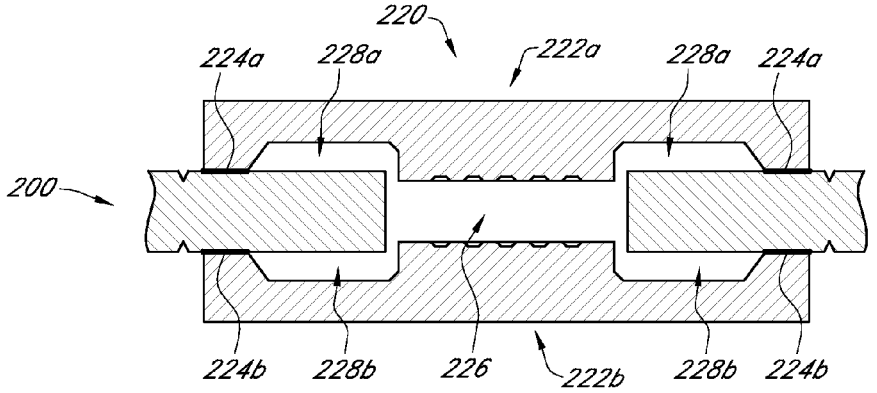
FIG. 6B shows an example where a GDT includes a flat insulator structure combined with shaped electrodes.

An example GDT 220 of FIG. 6B shows that a flat ceramic insulator structure such as the example of FIG. 5 can also be combined with shaped electrodes. In the example shown, an individual insulator structure corresponding to the GDT 220 can be a part of a plate 200 (e.g., a ceramic plate), to be singulated later. The example further shows shaped electrodes 222*a*, 222*b* mounted to the upper and lower surfaces of the flat ceramic insulator structure utilizing joints 224*a*, 224*b*.

Each of the electrodes 222*a*, 222*b* is shown to include a recessed portion (228*a* for electrode 222*a*, 228*b* for electrode 222*b*) that allows portions of the upper and lower surfaces of the flat ceramic insulator structure to be exposed to an enclosed volume 226. One or more pre-ionization lines can be implemented (e.g., formed by printing) on the surfaces (on the flat ceramic insulator structure) and exposed to the enclosed volume 226 due to the recessed portions 228*a*, 228*b* of the electrodes 222*a*, 222*b*.

In some implementations, the pre-ionization lines can be configured to reduce the response time of a GDT and therefore lower the impulse-spark-over voltage. In some implementations, these lines can be formed with graphite pencil. Other techniques can also be utilized.

In some implementations, the pre-ionization lines can be formed with different types of high resistance inks which could further enhance the impulse performance of the GDT.

Figure 6C:
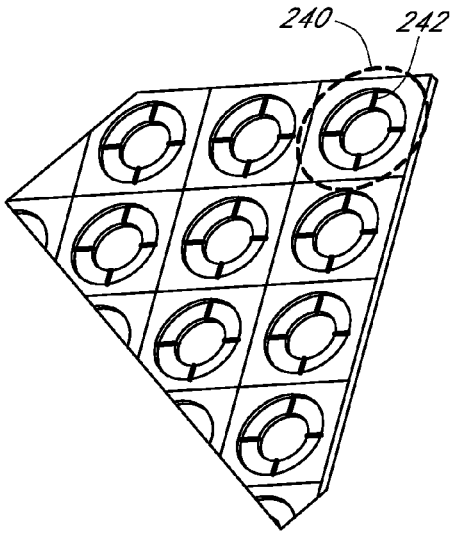
FIG. 6C shows that in some embodiments, one or more pre-ionization lines can be on each of a plurality of insulator structures.
Figure 6D:
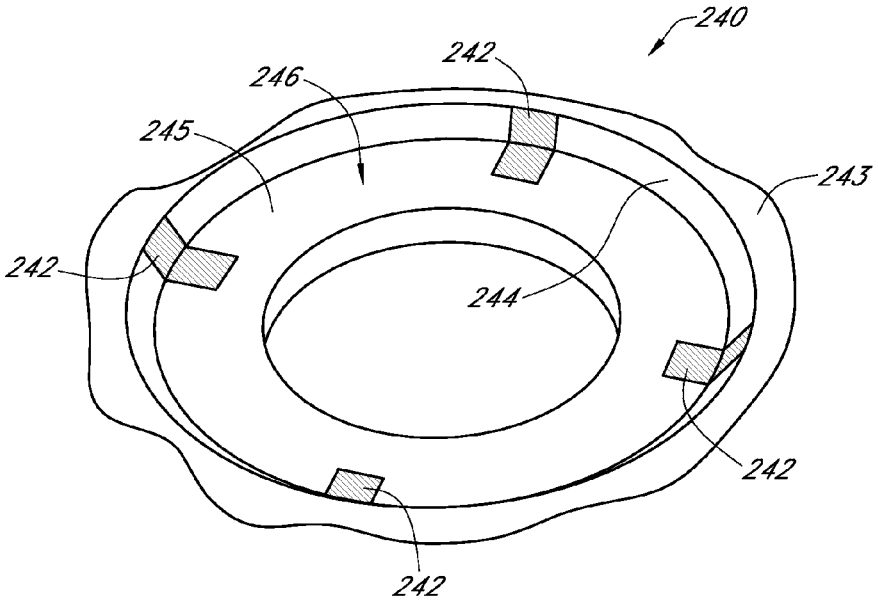
FIG. 6D shows an enlarged view of an insulator structure having a plurality pre-ionization lines.

As shown in an example of FIGS. 6C and 6D, pre-ionization lines can be applied to the inside walls of a ceramic insulator in different shapes and lengths as required or desired to meet desired impulse performance and standoff-voltage. The shapes of the lines can include, for example, circles, L, T or I-shapes, and such lines can be connected to the metallization layer (e.g., 132 in FIG. 2D), be floating lines, or some combination thereof. In some embodiments, the pre-ionization lines can include, but are not limited to, graphite, graphene, aqueous forms of carbon, and/or carbon nanotubes. Such pre-ionization lines can be applied using techniques such as printing, spraying, or marking using graphite pencils or rods.

In the example shown in FIG. 6C, pre-ionization lines 242 are shown to be applied to each of a plurality of insulator structures 240 that are still attached to each other. It will be understood, however, that such pre-ionization lines can also be applied at different stages of GDT fabrication as described herein.

FIG. 6D is an enlarged view of an insulator structure 240 having a plurality (e.g., four) pre-ionization lines 242. The example insulator structure 240 can be a part of an array (such as the example array of FIG. 6C) or be an individual unit. The example insulator structure 240 can be similar to the example 102 described in reference to FIGS. 1-3. Accordingly, the insulator structure 240 can include an upper surface 243 and a recess 246 defined by an inner side wall 244 and an inner lowered surface 245.

In the example shown, the pre-ionization lines 242 are formed on their respective azimuthal locations along the inner side wall 244 and a portion of the inner lowered surface 245. In some embodiments, the pre-ionization lines 242 can be arranged azimuthally in a generally symmetric manner. Although described in the context of four lines, it will be understood that other number of pre-ionization line(s) and configurations can also be implemented. In some embodiments, similar pre-ionization lines can also be provided on the lower side (not shown) of the insulator structure 240.

FIGS. 7-10 show various non-limiting examples of how GDTs fabricated as described herein can be grouped together. For the examples described in reference to FIGS. 1-6, it was assumed that an array of formed GDTs are singulated into individual units. FIG. 7A is another example configuration 250 where an array of GDTs 252 remain joined during fabrication, with singulation being facilitated by score lines. FIG. 8A shows a singulated GDT unit 252 having one set of electrodes 256 mounted to an insulator structure 254.

Figure 7A:
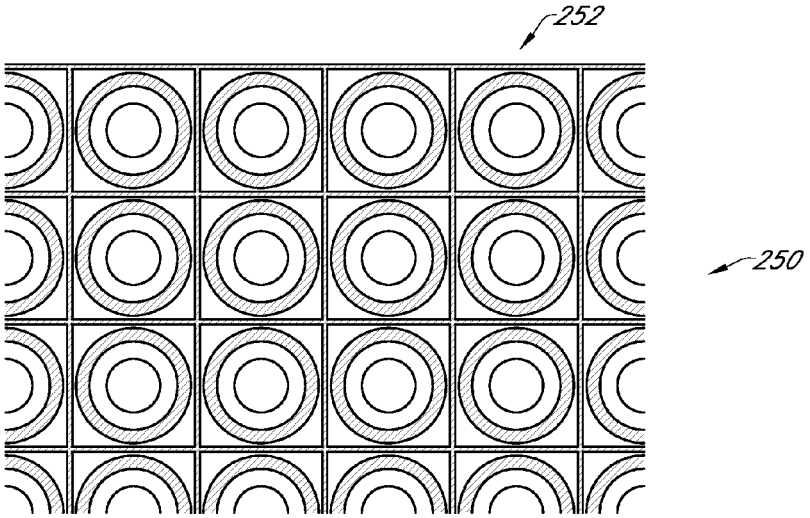
FIGS. 7A-7C show examples where arrays of GDTs remain joined during fabrication, and with score lines that facilitate singulation into respective single units having one or more GDTs.
Figure 7B:
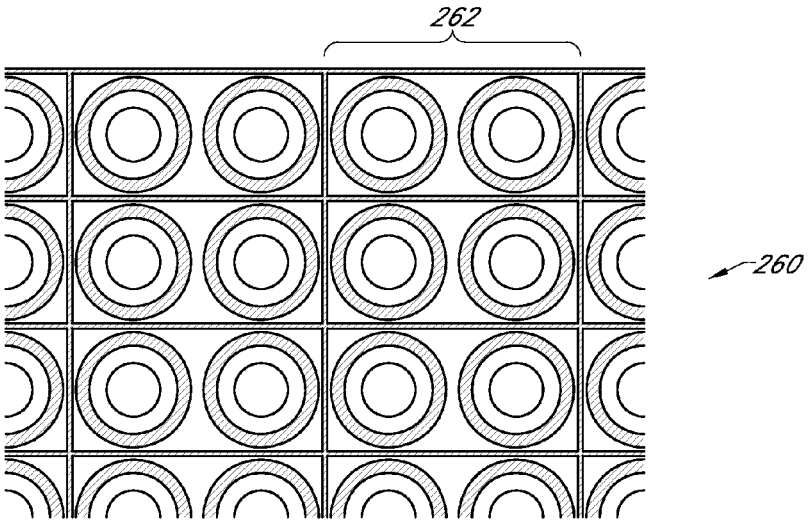
Figure 8A:
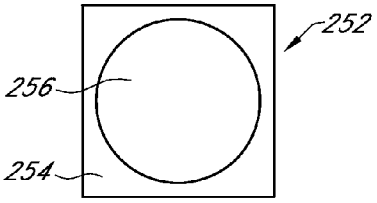
FIGS. 8A-8C show examples of individual units of GDT(s) that can be obtained from the example arrays of FIGS. 7A-7C.
Figure 8B:
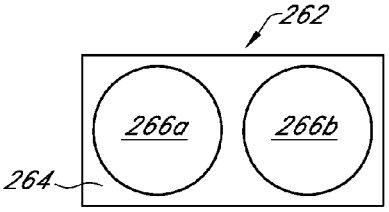

In some implementations, a singulated GDT unit can have more than one set of electrodes and their respective gas volumes. For example, FIG. 7B shows an array 260 having a plurality of GDT units 262, each having two sets of electrodes. FIG. 8B shows an individual singulated GDT unit 262 having first and second sets of electrodes 266*a*, 266*b* mounted to an insulator structure 264. The first set of electrodes 266*a* (upper one shown, lower one hidden from view) and the insulator structure 264 can define a first enclosed gas volume (hidden from view). Similarly, the second set of electrodes 266*b* and the insulator 264 structure can define a second enclosed gas volume.

In some embodiments, a ceramic plate having an array of insulator structures 264 can include score lines (e.g., as shown in FIG. 7B) that define the example two-unit groups. In some embodiments, such two-GDT devices can be formed from a ceramic plate having single-unit groups (e.g., FIG. 7A) by selective singulation into two-unit devices. In some embodiments, the metalizing layers of the two-unit devices can be connected.

Figure 7C:
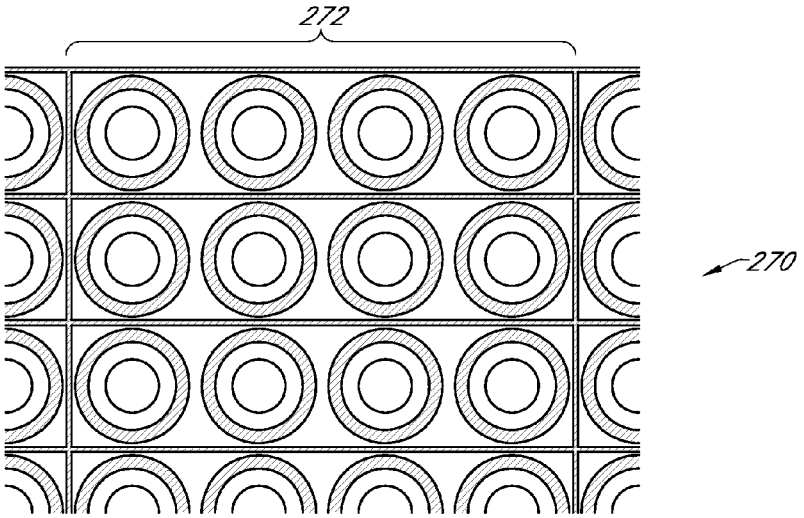
Figure 8C:
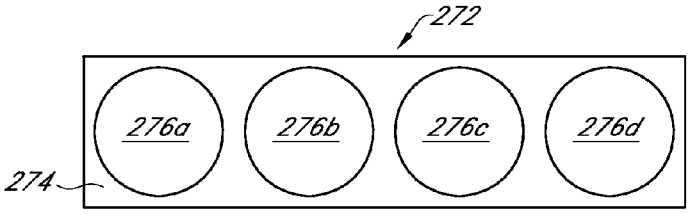

FIG. 7C shown another example of an array 270 having a plurality of GDT units 272, each having four sets of electrodes. FIG. 8C shows an individual singulated GDT unit 272 having four sets of electrodes 276*a*-276*d* mounted to an insulator structure 274. Each set of electrodes 276 and the insulator structure 274 can define a respective enclosed gas volume.

In some embodiments, a ceramic plate having an array of insulator structures 274 can include score lines (e.g., as shown in FIG. 7C) that define the example four-unit groups. In some embodiments, such four-GDT devices can be formed from a ceramic plate having lesser-number-unit groups such as single-unit groups (e.g., FIG. 7A) by selective singulation into four-unit devices.

It will be understood that GDT units having other numbers of electrode sets with series and/or parallel GDT connections can also be implemented. In the multiple-GDT example of FIG. 7C, the GDTs are arranged in a single line. It will be understood that other arrangements are also possible. For example, multiple GDT units can be arranged in more than one line (e.g., in 2×2 arrangement for the four-GDT configuration). For odd-numbered configurations, it may be more preferable to maintain the single-line arrangement since the GDTs do not group into an overall rectangular shape for easier singulation. In some embodiments, more than one ceramic plate assembly can be placed on top of each other to form one or more stacks. Such stacks can be separated, for example, at any point after brazing or soldering thereof.

The more-than-one GDT on a common insulator structure as described in reference to the examples of FIGS. 7B and 7C can provide a number of desirable features. For example, a higher density of GDTs per area can be achieved. It is noted that metallization for the braze seal typically needs to be positioned away from a score line by some distance to eliminate or reduce the likelihood of micro-cracks originating from the score line and affecting the braze seal. With the more-than-one GDT on a common insulator structure, a score line does not need to be formed between a pair of GDTs. Accordingly, GDTs can be positioned closer together within the common insulator structure.

In the example configurations of FIGS. 7B and 7C, the electrodes and/or the metalizing layers can be connected in different ways to yield GDTs connected in series, in parallel, or some combination thereof. In some implementations, it can be desirable to provide discharge protection with a plurality of parallel lines connected to a common ground. For such configurations, reduced and simplified connections can be achieved by connecting together the first electrodes of the GDTs on the first side, and connecting together the second electrodes of the GDTs on the second side. In some embodiments, such a configuration can be implemented with larger ground and common connection tabs to facilitate, for example, removal of heat out of the GDT package. Such a feature can improve, for example, AC-surge handling capabilities and long-duration surges.

Figure 9A:
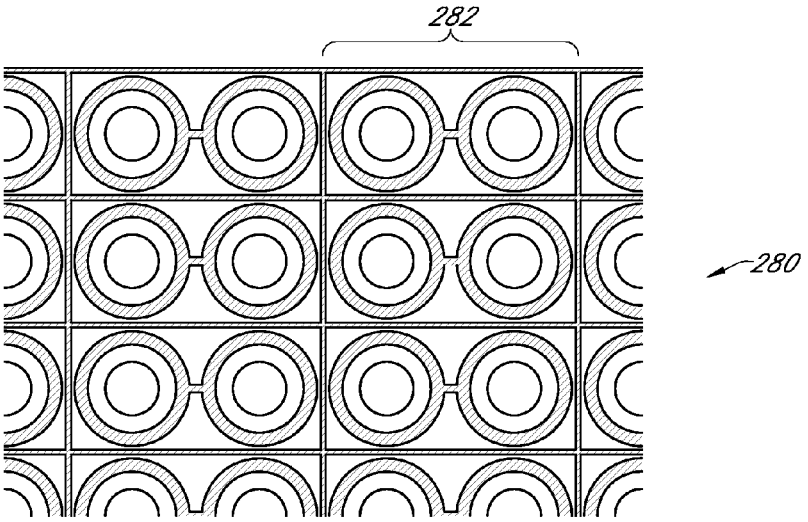
FIGS. 9A and 9B show examples of arrays having a plurality of GDT-based devices each having a plurality of sets of electrodes.
Figure 10A:
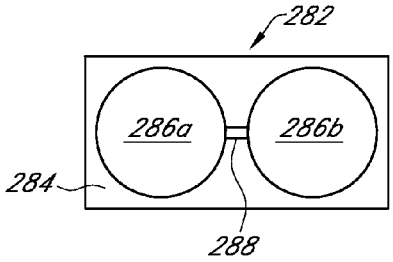
FIGS. 10A and 10B show examples of individual GDT-based devices that can be obtained from the example arrays of FIGS. 9A and 9B.

FIG. 9A shows an example array 280 having a plurality of GDT-based devices 282 each having two sets of electrodes. FIG. 10A shows an individual GDT-based device 282 that has been singulated and having two GDT cells. The first electrodes 286*a*, 286*b* on the first side of a common insulator structure 284 of the GDT-based device 282 are shown to be connected to each other by a conductor 288. Similarly, the second electrodes (hidden from view) on the second side of the GDT-based device 282 are connected to each other by a conductor.

Figure 9B:
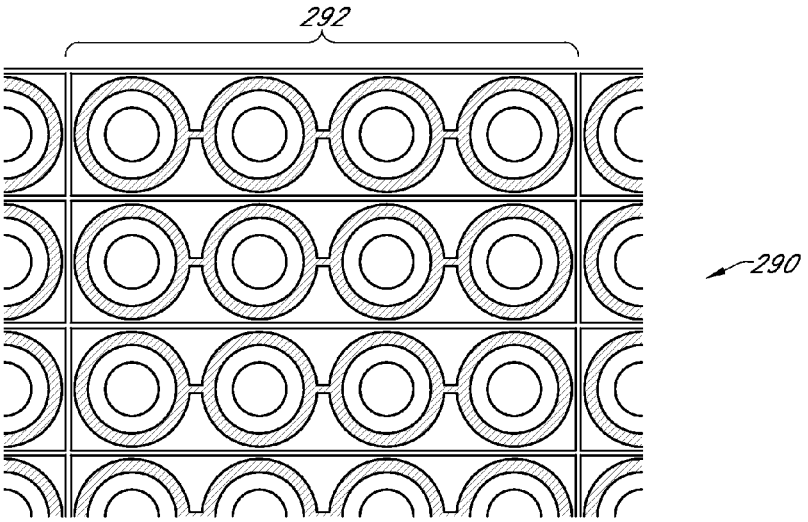

FIG. 9B shows an example array 290 having a plurality of GDT-based devices 292 each having four sets of electrodes.

Figure 10B:
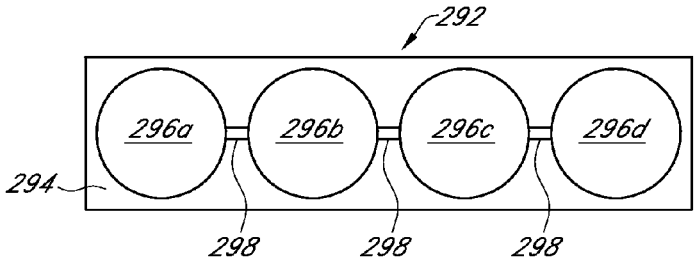

FIG. 10B shows an individual GDT-based device 292 that has been singulated and having four GDT cells. The first electrodes 296*a*-296*d* on the first side of a common insulator structure 294 of the GDT-based device 292 are shown to be connected to each other by a conductor 298. Similarly, the second electrodes (hidden from view) on the second side of the GDT-based device 292 are connected to each other by a conductor.

In some embodiments, the example conductors (e.g., 288 in FIG. 10A, 298 in FIG. 10B) can be un-separated joining tabs 162' of an array of electrodes described herein in reference to FIGS. 2D', 3D' and 4B. In some embodiments, the example conductors (e.g., 288 in FIG. 10A, 298 in FIG. 10B) can be formed separately. In some embodiments, the metallization layers of two or more devices can be connected.

In some implementations, various examples of GDT units described above can be connected directly in electrical circuits. In some implementations, the GDTs can be included in packaged devices. Non-limiting examples of such packaged devices are described in reference to FIGS. 11-14.

Figure 11A:
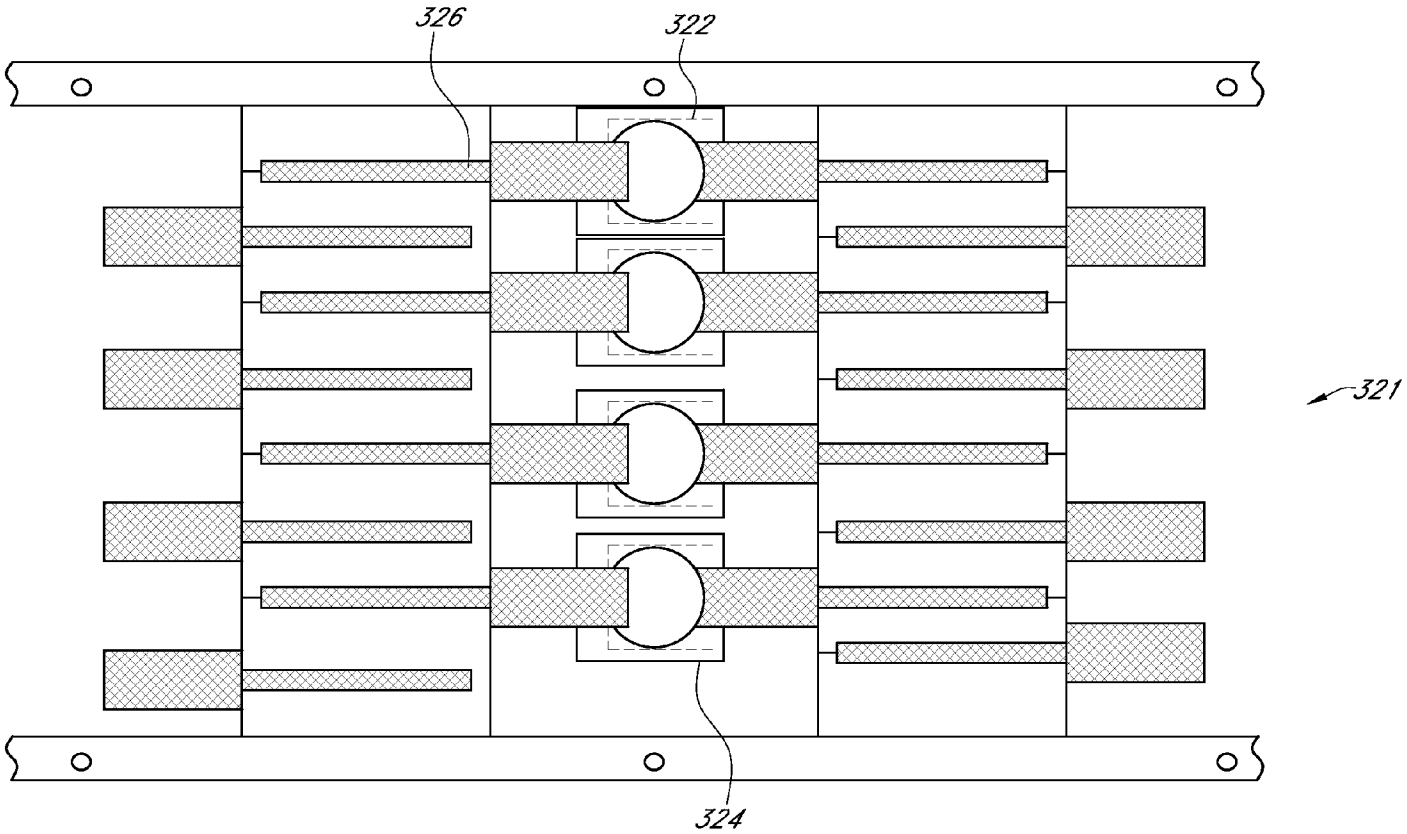
FIG. 11A shows an example of how a GDT having one or more features as described herein can be implemented in a packaged configuration.
Figure 11B:
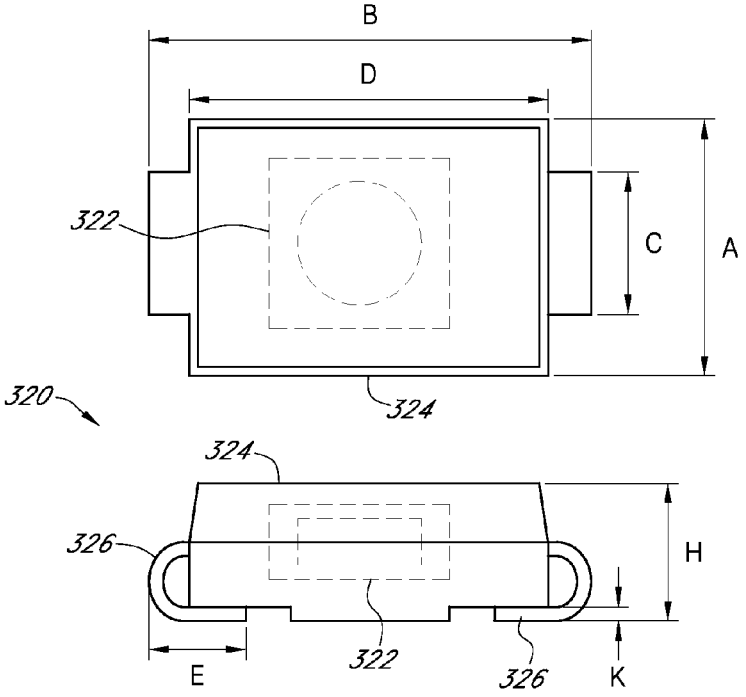
FIG. 11B shows that in some embodiments, terminals in the example of FIG. 11A can be configured to allow surface mounting of the packaged device on a circuit board.
Figure 11C:
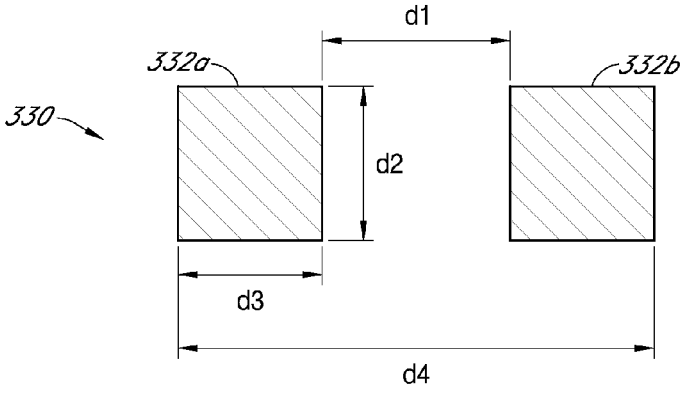
FIG. 11C shows an example pad layout that can be implemented on a circuit board to receive the packaged GDT device of FIG. 11B.

FIGS. 11A-11C show an example of how a GDT device having one or more features as described herein can be packaged using a lead frame configuration 321. FIG. 11A shows that in some embodiments, the packaging configuration 321 can be implemented in, for example, SMB (DO-214AA), SMC (DO-214AB) or any format appropriate for packaging using the lead-frame assembly. A GDT device 322 can be housed in a housing 324. Electrical connections can be made with the lead-frame 321 between the electrodes of the GDT devices 322 and terminals 326. FIG. 11B shows that in some embodiments, the terminals 326 can be configured (e.g., folded over after being separated from the lead-frame assembly) to allow the packaged device 320 to be surface mounted on a circuit board.

FIG. 11C shows an example pad layout 330 that can be implemented on, for example, a circuit board to receive the packaged GDT device 320 of FIG. 11B. The layout 330 is shown to include first and second contact pads 332*a*, 332*b* dimensioned and spaced to receive the first and second terminals 326 of the packaged GDT device 320. The various dimensions and spacings (e.g., d1-d4) can be selected appropriately to facilitate surface mounting of the packaged GDT device 320.

Figure 12A:
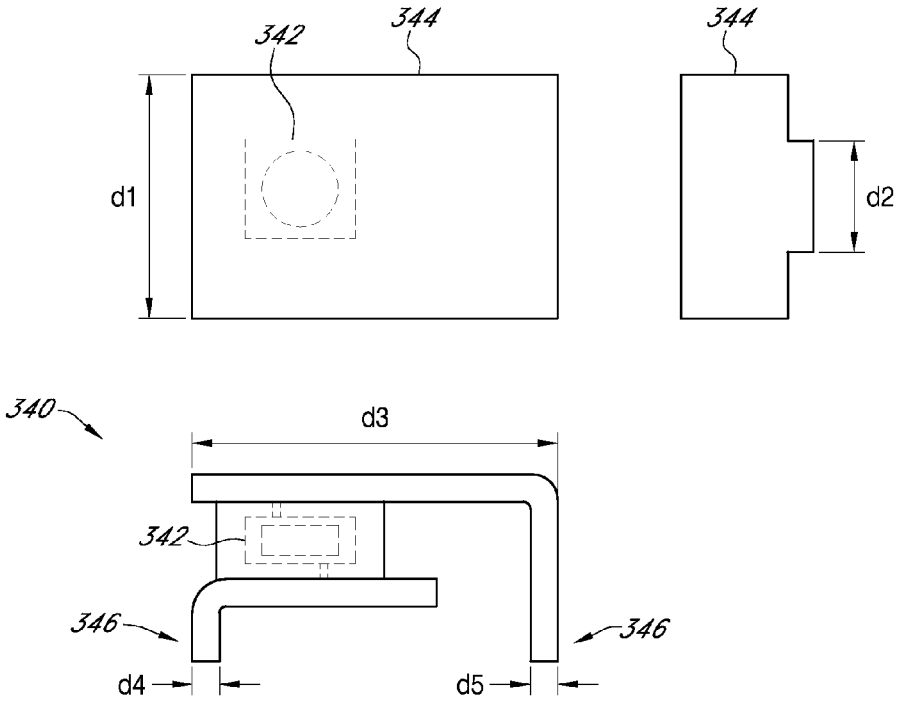
FIG. 12A shows another example of how a GDT having one or more features as described herein can be implemented in a packaged configuration.

FIG. 12A shows another example of a packaging configuration 340 that can be implemented. In some embodiments, the packaging configuration 340 can be implemented in an SMD 2920 format, or a similar format. A GDT device 342 can be implemented between two conductor structures 344 that are connected to first and second terminals 346. The terminals 346 can be dimensioned (e.g., d1-d5) to allow the packaged device 340 to be surface mounted on a circuit board.

Figure 12B:
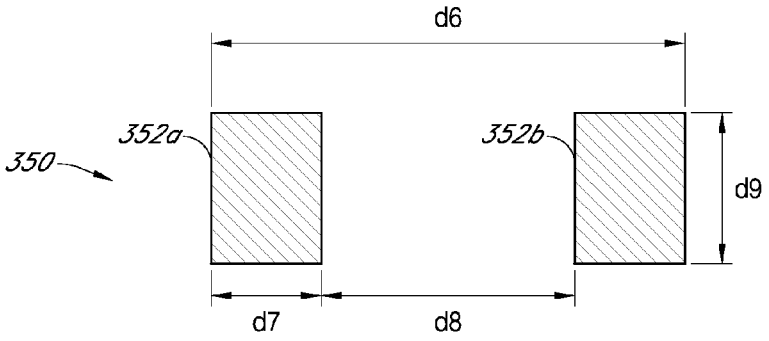
FIG. 12B shows an example pad layout that can be implemented on a circuit board to receive the packaged GDT device of FIG. 12A.

FIG. 12B shows an example pad layout 350 that can be implemented on, for example, a circuit board to receive the packaged GDT device 340 of FIG. 12A. The layout 350 is shown to include first and second contact pads 352*a*, 352*b* dimensioned and spaced to receive the first and second terminals 346 of the packaged GDT device 340. The various dimensions and spacings (e.g., d6-d9) can be selected appropriately to facilitate surface mounting of the packaged GDT device 340.

Figure 13A:
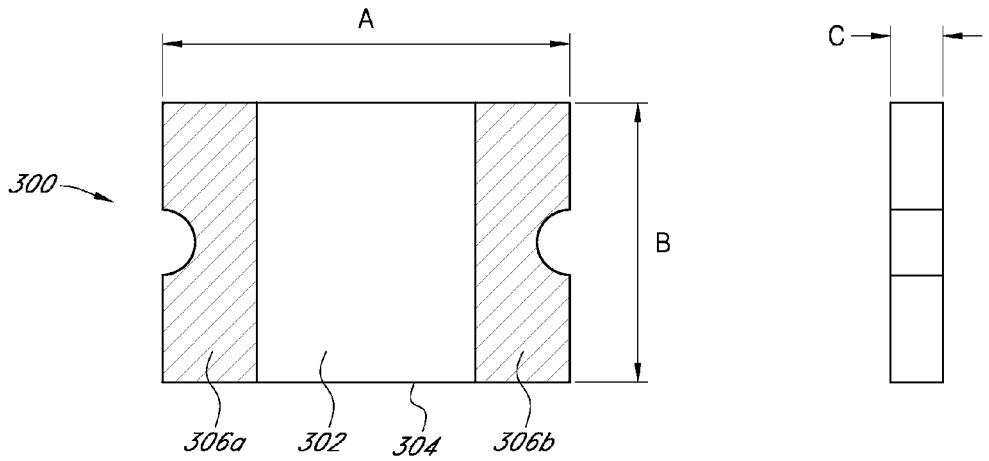
FIG. 13A shows that in some embodiments, a GDT device having one or more features as described herein can be implemented in a packaging configuration commonly used for positive temperature coefficient (PTC) devices.

FIG. 13A shows that in some embodiments, a GDT device 302 having one or more features as described herein can be implemented in a packaging configuration 300 commonly used for positive temperature coefficient (PTC) devices. In some embodiments, one or more GDT-based devices can be packaged with one or more non-GDT devices such as multifuse polymeric or ceramic PTC devices, electronic current-limiting devices, diodes, diode bridges or arrays, inductors, transformers, resistors, or other commercially available active or passive devices that can be obtained from, for example, Bourns, Inc.

The example packaged GDT device 300 can include a packaging substrate 304 that encapsulates the GDT 302 and the electrical connections between the GDT electrodes and the terminals 306*a*, 306*b*. Such electrical connections can be achieved in a number of ways. Further, lateral dimensions A, B, and thickness dimension C can be selected to provide a desired sized device having desired functionalities.

Figure 13B:
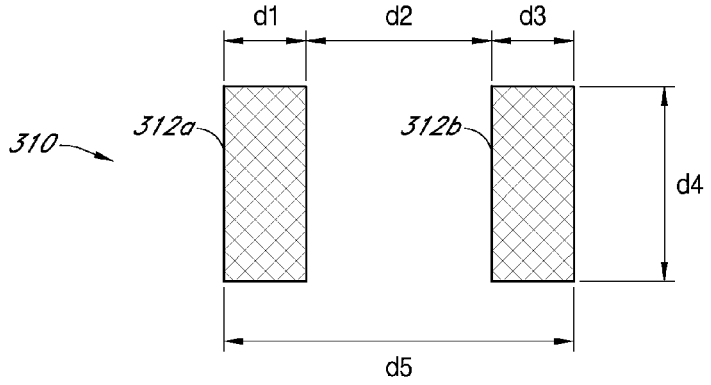
FIG. 13B shows an example pad layout that can be implemented on a circuit board to receive the packaged GDT device of FIG. 13A.

FIG. 13B shows an example pad layout 310 that can be implemented on, for example, a circuit board to receive the packaged GDT device 300 of FIG. 13A. The layout 310 is shown to include first and second contact pads 312*a*, 312*b* dimensioned and spaced to receive the first and second terminals 306*a*, 306*b* of the packaged GDT device 300. The various dimensions and spacings (e.g., d1-d5) can be selected appropriately to facilitate surface mounting of the packaged GDT device 300.

Figure 14A:
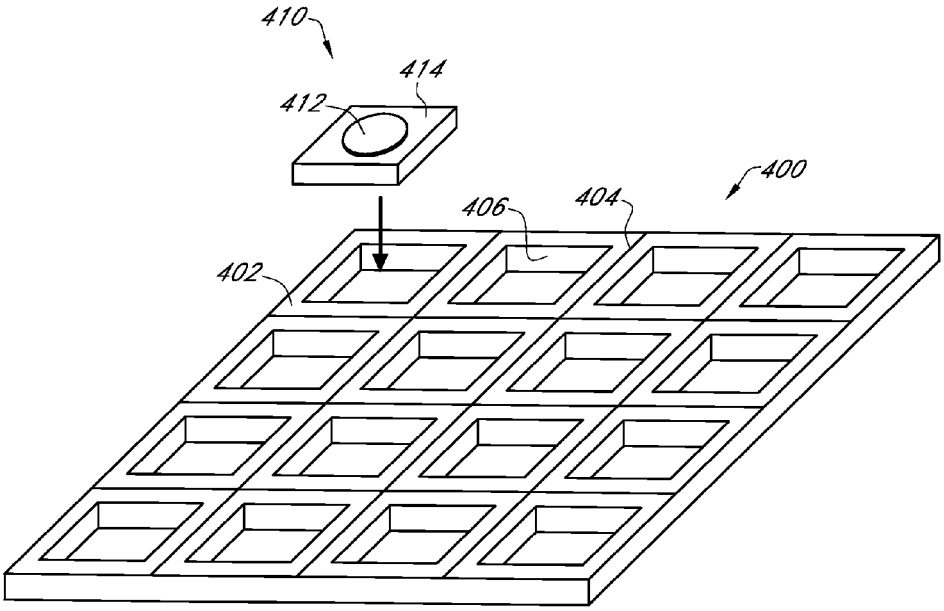
FIG. 14A shows an example configuration where an array of pockets can be defined on a packaging substrate, with each pocket being configured to receive a GDT device having one or more features as described herein.

FIGS. 14A-14H and 15A-15J show other examples of packaging configurations that can be implemented. FIG. 14A shows a configuration 400 where an array of pockets 406 are defined on a packaging substrate 402. Additional details concerning such an array of pocket structures can be found in, for example, U.S. Patent Application Publication No. 2006/0055500, which is expressly incorporated by reference in its entirely. For the purpose of description of the examples in FIGS. 14A-14H and 15A-15J, it will be understood that various terms can be used interchangeably, as alternate forms, and/or as modified appropriately by one of ordinary skill in the art, as the generally corresponding terms used in the foregoing disclosure in U.S. Patent Application Publication No. 2006/0055500.

In some embodiments, each of the pockets 406 can be filled with a GDT device 410 having one or more features (e.g., electrodes 412 mounted to a ceramic insulator structure 414) as described herein. Such filled pockets 406 can then be singulated to yield individual packaged devices. In some embodiments, score lines 404 can be provided to facilitate such a singulation process.

In some embodiments, a group of pockets 406 can be filled with at least one GDT device 410 and one or more of other devices. Such other devices can include, for example, multifuse polymeric or ceramic PTC devices, electronic current-limiting devices, diodes, diode bridges or arrays, inductors, transformers, resistors, or other commercially available active or passive devices that can be obtained from, for example, Bourns, Inc. In some embodiments, such a group of pockets and their respective devices can be retained together in a modular form.

Figure 14B:
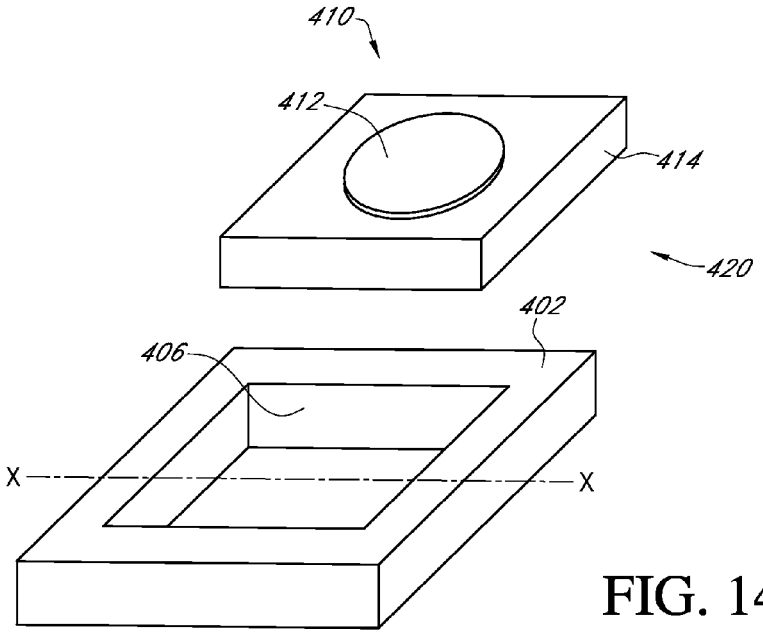
FIG. 14B shows a closer view of an individual packaged device in an unassembled form.
Figure 14C:
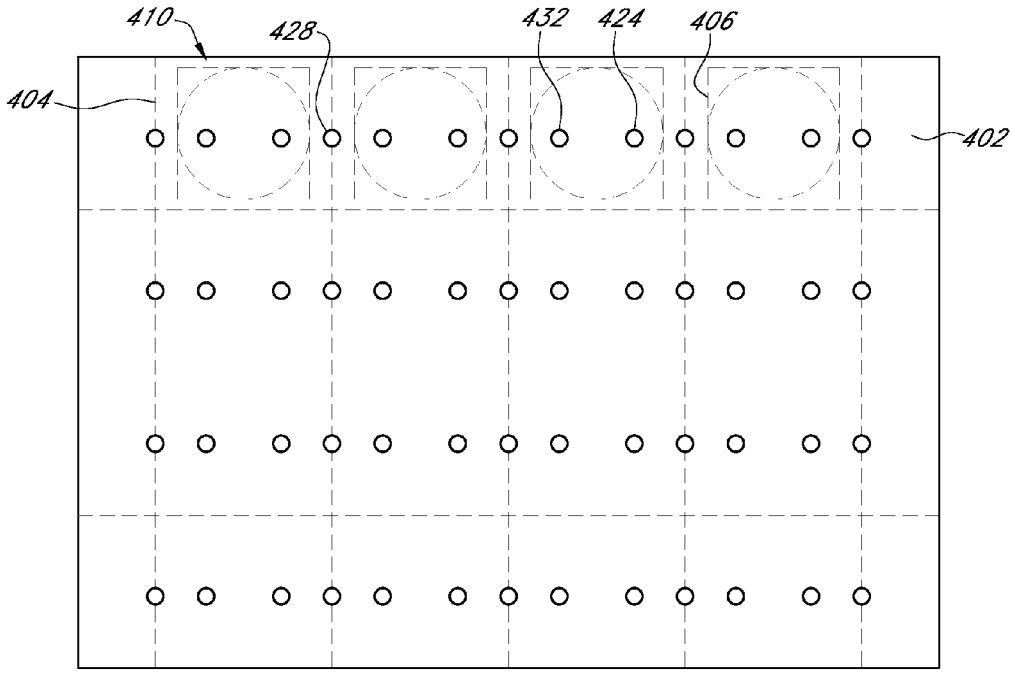
FIG. 14C shows a plan view where a packaging substrate with GDT-based devices and/or any other components or combinations as described herein can include interconnecting vias.
Figure 14D:
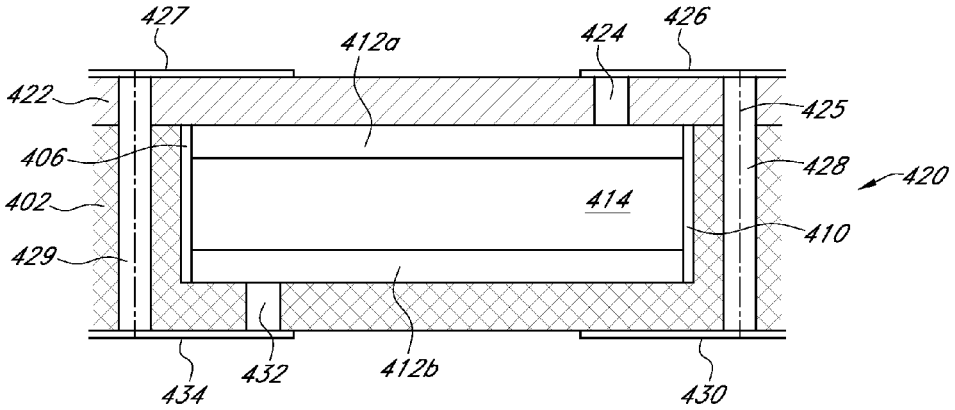
FIG. 14D shows a side sectional view of the device in an assembled form along the line XX of FIG. 14B.

FIG. 14B shows a closer view of an individual packaged device 420 in an unassembled form, and FIG. 14D shows a side sectional view of the device 420 in an assembled form along the line XX of FIG. 14B. In some embodiments, the overall dimensions of the GDT device 410 and the dimensions of the pocket 406 can be selected to facilitate insertion and retaining of the GDT device 410 in the pocket 406. The GDT device 410 can be retained by friction fit, and/or other methods such as an adhesive.

FIGS. 14C and 14D show an example configuration where the packaging substrate 402 with GDT-based devices 410 and/or any other components or combinations as described herein (e.g., which are laminated with an insulation layer 422 after which the holes for the interconnecting vias 424, 425, 429, 432 are drilled by laser or mechanically). The interconnecting vias can be configured to complete or facilitate electrical connections between electrodes 412*a*, 412*b* and terminals 426, 430 and 427, 434 respectively (e.g., see FIGS. 14D-14H).

In some embodiments, a group of pockets 406 as seen in FIG. 14A-14C can be formed by injection molding, thus encapsulating some or all GDT-based devices 410 and/or other components in one process replacing both the packaging substrate 402 and insulation layer 422 shown in FIG. 14D. As shown in FIG. 14D, the example GDT device 410 is shown to include upper and lower electrodes 412*a*, 412*b* mounted to a ceramic insulator structure 414. When mounted within the pocket 406, the lower electrode 412*b* can be positioned against the bottom surface of the pocket 406. An insulation layer 422 can be formed or laminated above the pocket 406 to thereby generally cover the upper electrode 412*a*.

FIG. 14D further shows an example of how the electrodes 412*a*, 412*b* can be connected to their respective terminals 426, 430 as well as 427,434. A conductive via 424 is shown to be formed through the insulation layer 422 so as to provide an electrical connection between the upper electrode 412*a* and an upper terminal 426. The upper terminal 426 is shown to provide an electrical connection between the conductive via 424 and another conductive via 428 that extends through the upper insulation layer 422 and the packaging substrate 402. The lower portion of the via 428 is shown to be connected to the lower terminal 430. Similarly, a conductive via 432 is shown to be formed through the floor of the packaging substrate 402 so as to provide an electrical connection between the lower electrode 412*b*, lower terminal 434, conductive via 429, as well as the upper terminal, 427. In some embodiments, a packaged GDT device formed in the foregoing manner can be mounted to circuit boards as a surface mount device.

Figure 14E:
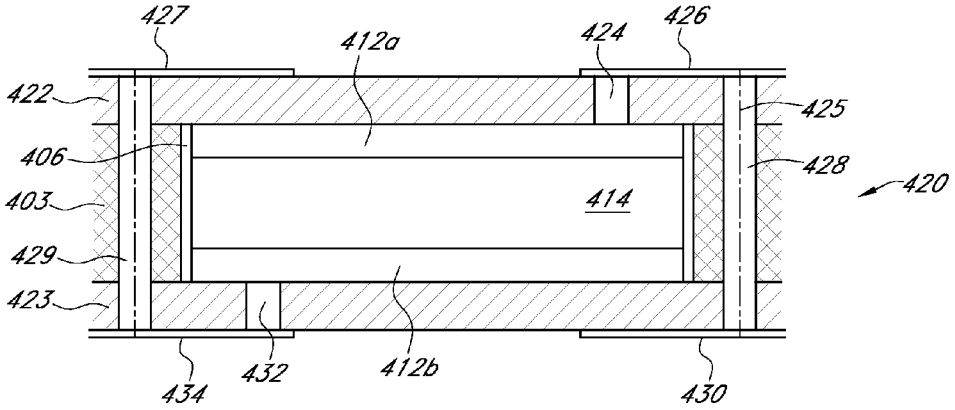
FIG. 14E shows another example configuration of the assembly in FIG. 14D using a packaging substrate which can be open ended both at the top and bottom sides.

FIG. 14E shows another example configuration of the assembly in FIG. 14D using a more simple packaging substrate 403 which can be open ended both at the top and bottom sides. In this example, insulation layers 422, 423 can be formed or laminated above and underneath pocket 406 to cover both upper and lower electrodes 412*a*, 412*b* respectively. Conductive vias 424, 428 and 429, 432 can connect the GDT electrodes 412*a* and 412*b* respectively through the top and bottom insulation layers 422, 423 and the packaging substrate 403 with the terminals 426, 430 as well as 427, 434 respectively.

Figure 14F:
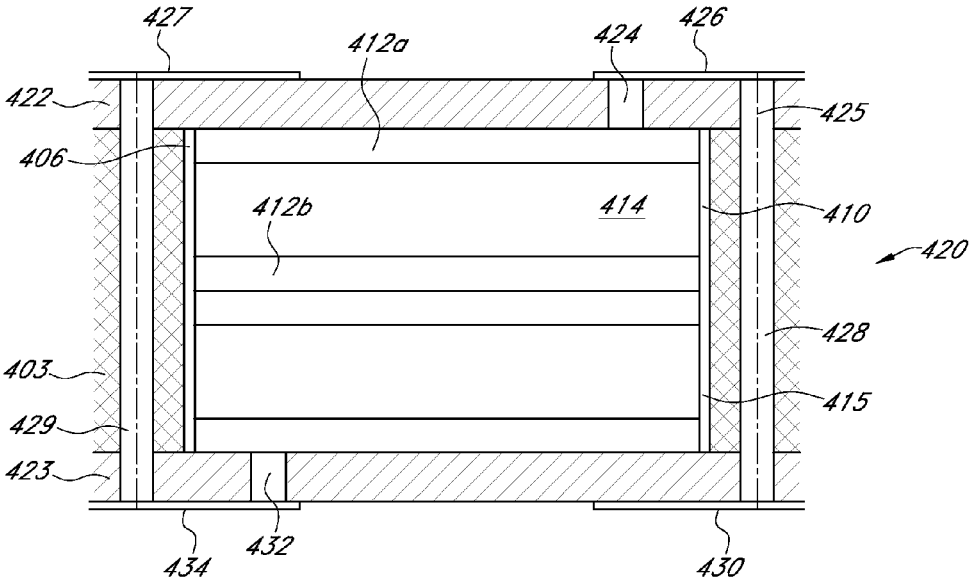
FIG. 14F shows an example configuration that includes a series stack of devices, with the stack including a GDT and another GDT, device or combination of devices.

FIG. 14F shows an example embodiment that could include a stack of devices (e.g., in a series stack) which could include a GDT 410 and another GDT, device or combination of devices 415. It will be understood that this example configuration is not limited to two devices but could include more than two devices in the stack. With different connection via and insulation layer arrangements, electrically series, parallel, or series-parallel combinations are possible.

Figure 14G:
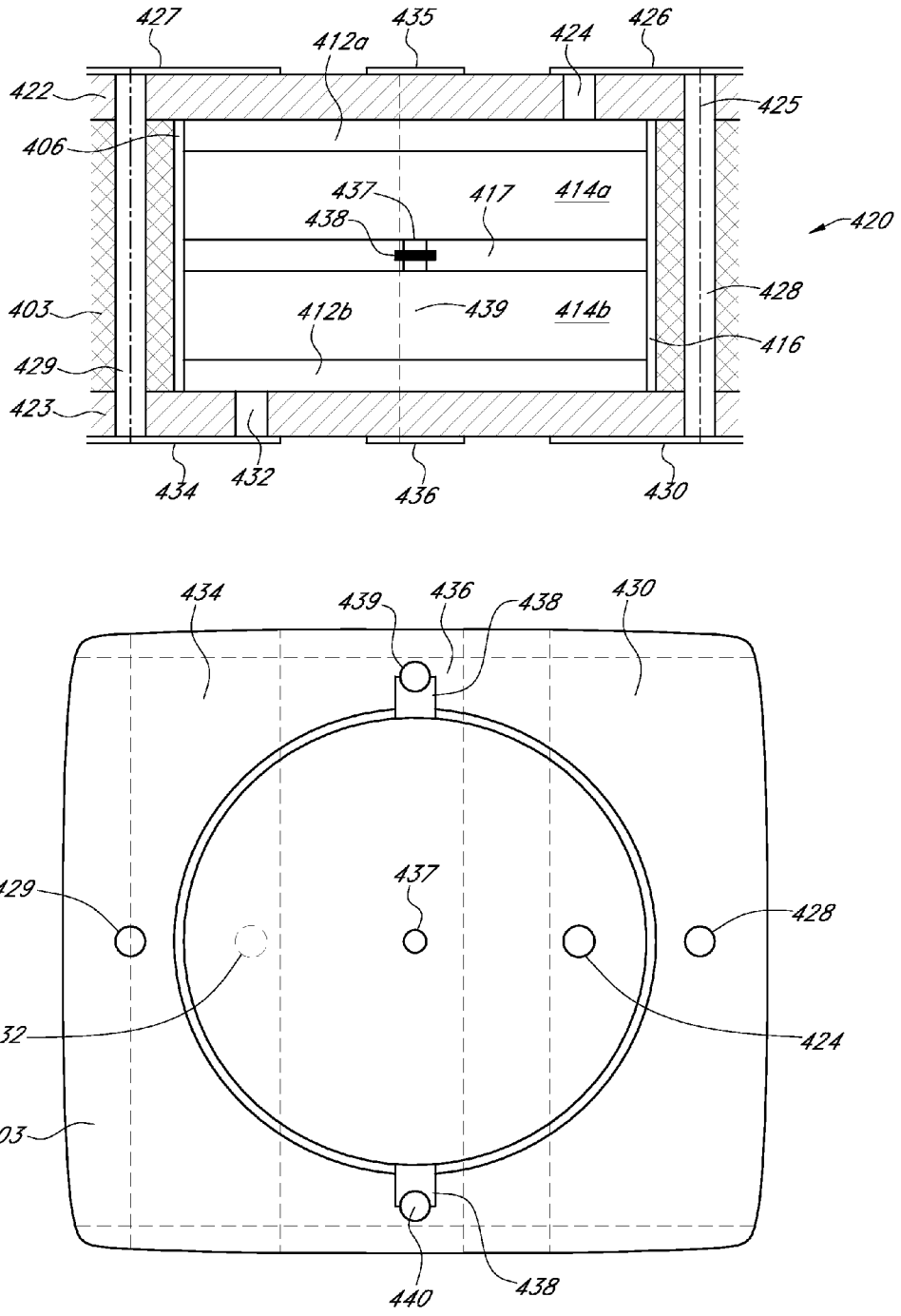
FIG. 14G shows an example configuration that includes a third common connection which could be connected to common center electrode tabs with two vias to provide one or more desirable functionalities.

FIG. 14G shows an example embodiment that can include a third common connection 435, 436 which could be connected to common center electrode (417) tabs 438 with two vias 439, 440 if required or desired for current handling capabilities, or in order to reduce inductance and/or other parasitics.

The example shown in FIG. 14G shows a two-layered GDT 416 that includes ceramics 414*a*, 414*b* and electrodes 412*a*, 417 and 412*b*. The common center electrode 417 can define a hole 437 (e.g., in the center of the electrode) in order to provide a connection between the top and bottom gas chambers. Connecting the two gas chambers can improve impulse spark over balance between the top and bottom halves of the example two-layered (3-terminal) GDT 416 and thus can reduce the transverse voltage during common mode surges. It will be understood that one or more features associated with this example implementation is not limited to GDT-only combinations but could be used in any combination with devices of different technologies.

Figure 14H:
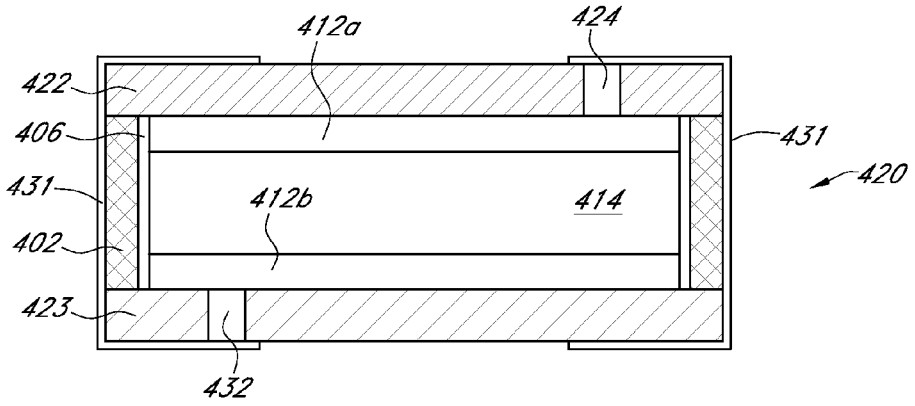
FIG. 14H shows an example configuration of the assembly in FIG. 14E without connection vias, but with terminals implemented in such a manner to wrap around the sides of the body connecting top and bottom pads together.

FIG. 14H shows another example configuration of the assembly in FIG. 14E without connection vias 428, 429. Instead, the terminals can be implemented in such a manner to wrap around the sides 431 of the body connecting top and bottom pads together.

In the various examples described in reference to FIGS. 14C-14H, conductive vias 424, 432 are shown to be formed through their respective insulation layers 422 so as to form electrical connections with their respective upper and lower electrodes 412*a*, 412*b*. In some implementations, it may be desirable to have a different connection configuration for the electrodes 412*a*, 412*b* to provide, for example, greater power handling capability.

FIGS. 15A-15J show an example of a packaged GDT device 500 (FIGS. 15I and 15J) having electrical connections to the electrodes 412*a*, 412*b* without relying on conductive vias such as the foregoing vias 424, 432. As described herein, such connections to the electrodes 412*a*, 412*b* without the conductive vias 424, 432 can remove the need to perform blind-drill operations, as well as improving the power handling capability.

Figure 15A:
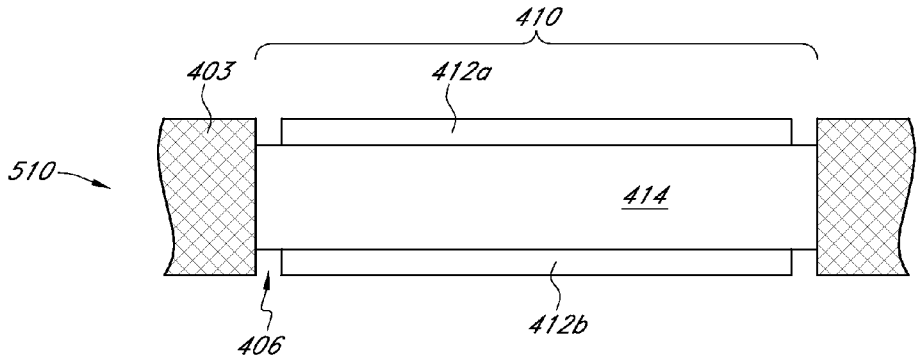
FIGS. 15A-15H show various stages of an example fabrication process that can yield a plurality of packaged GDT devices having electrical connections to electrodes without relying on conductive vias.
Figure 15B:
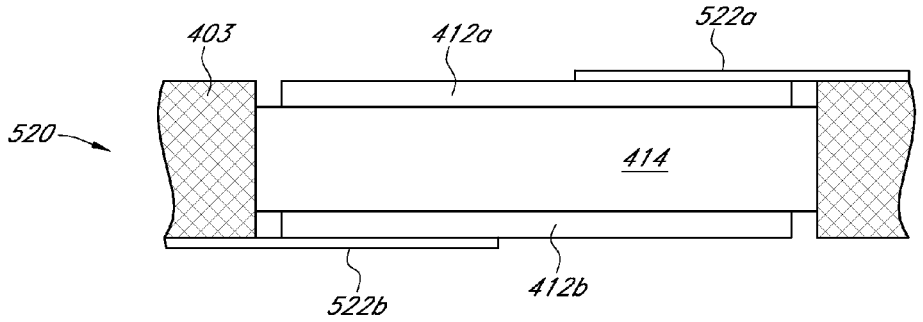
Figure 15B:
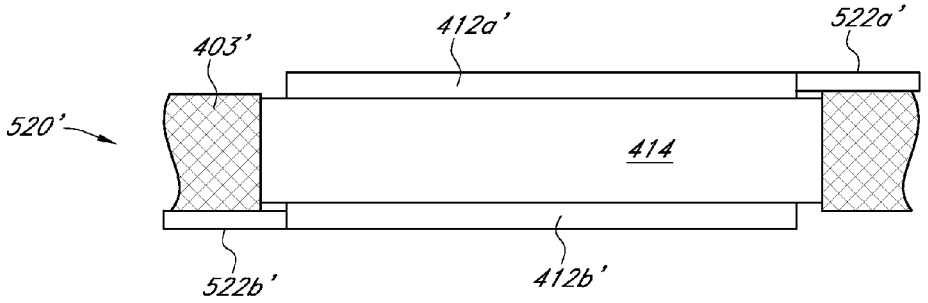
Figure 15C:
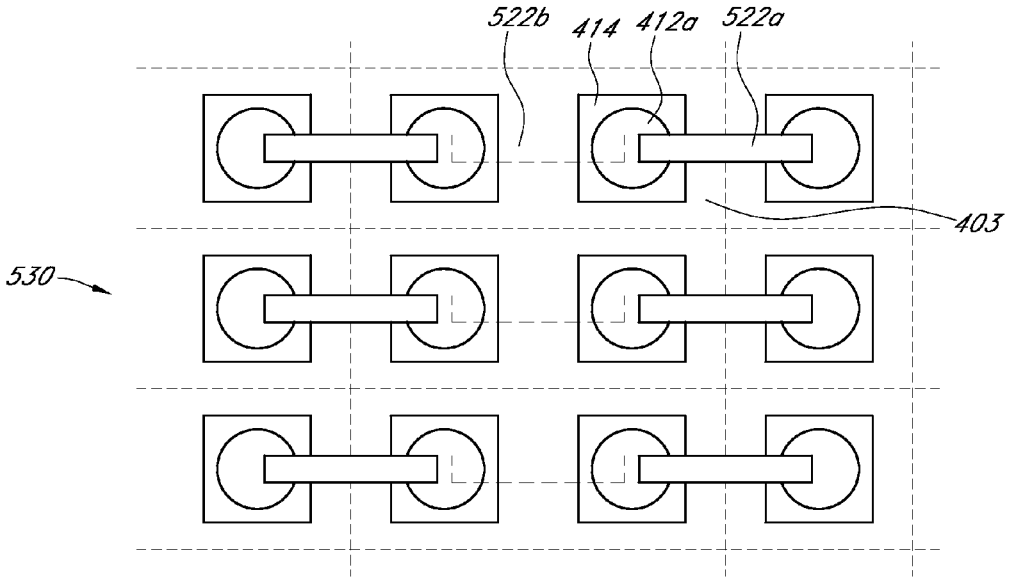
Figure 15D:
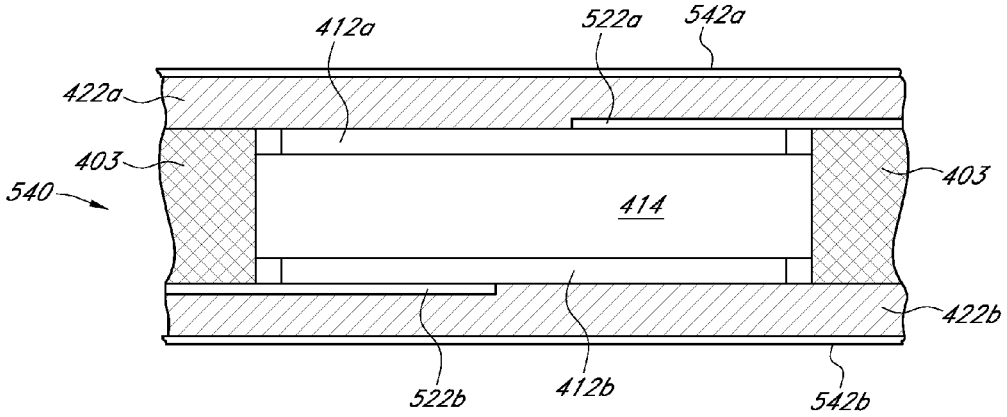
Figure 15E:
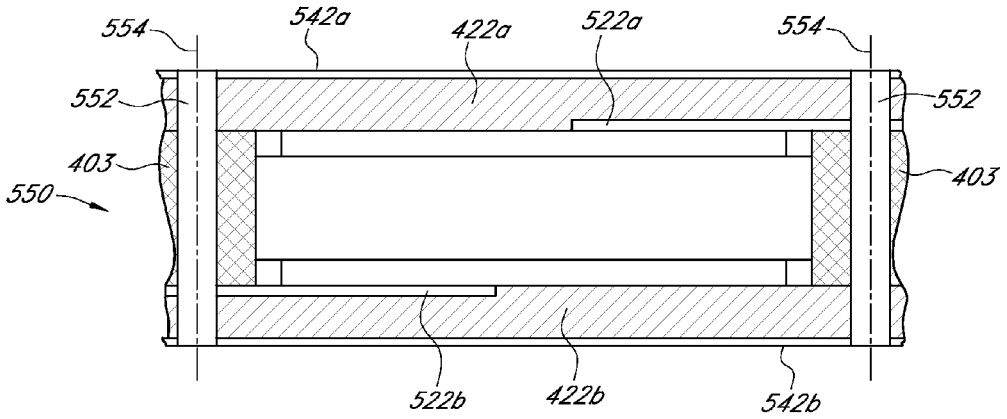
Figure 15F:
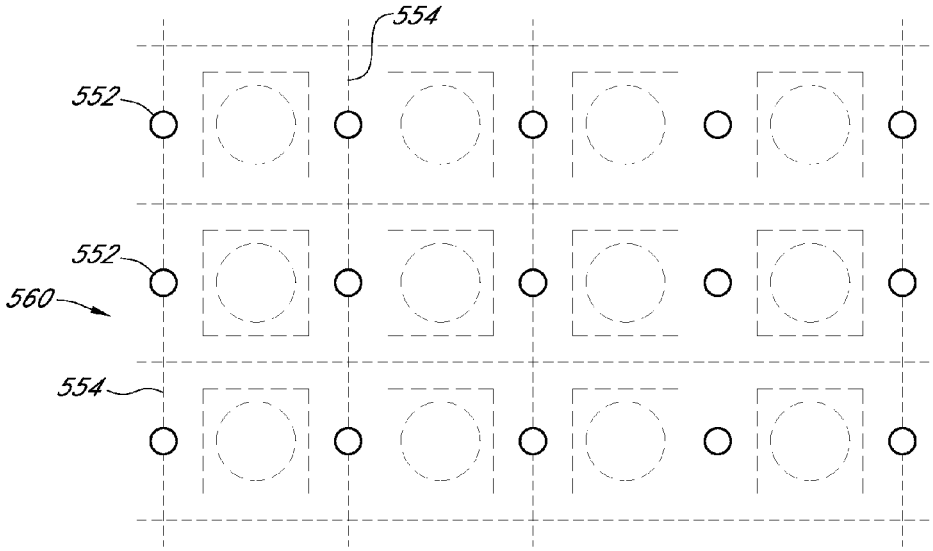
Figure 15G:
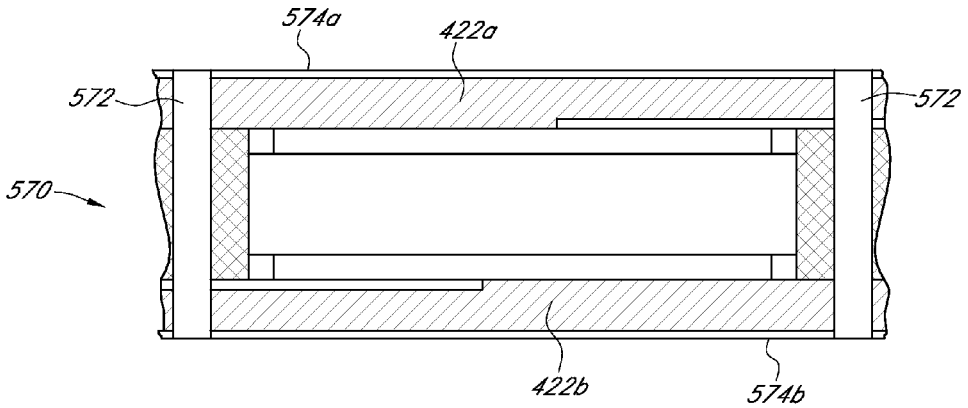
Figure 15H:
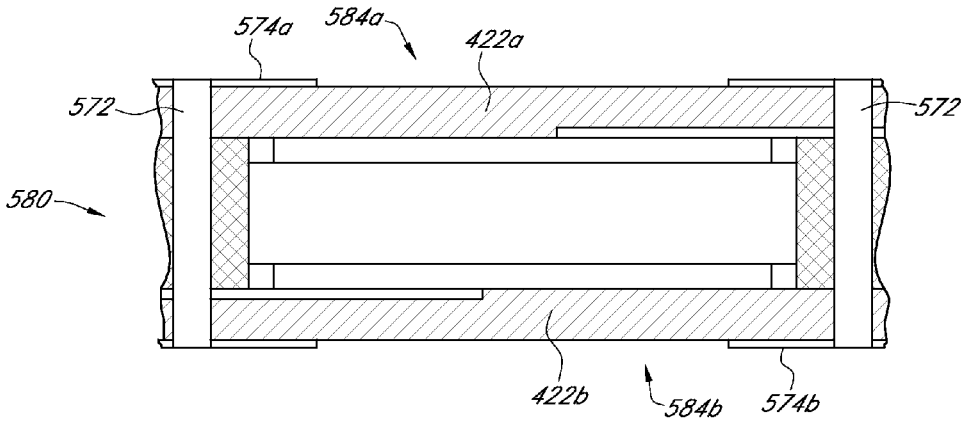
Figure 15I:
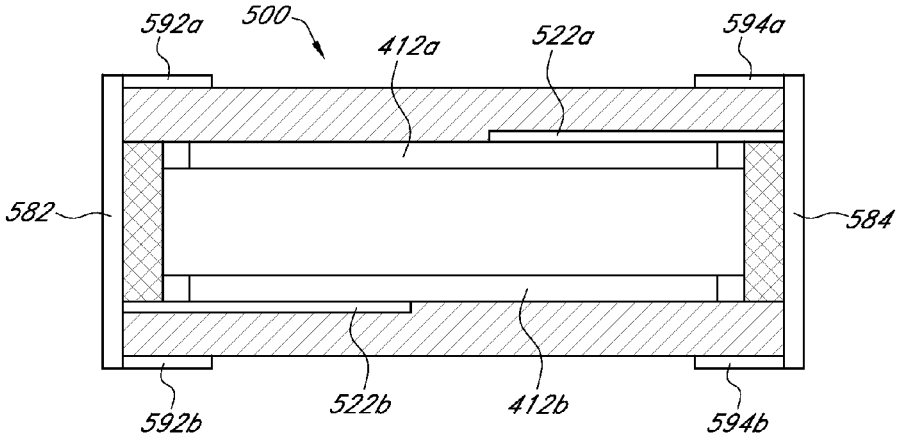
FIGS. 15I and 15J show side and plan views of an individual packaged GDT device that can result from the fabrication process of FIGS. 15A-15H.
Figure 15J:
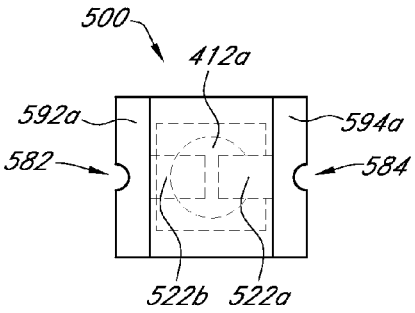

FIGS. 15A-15H show various stages of an example fabrication process that yields the example packaged GDT device 500 of FIGS. 15I and 15J. In an example stage 510 of FIG. 15A, a GDT device 410 having one or more features of the present disclosure can be positioned in a pocket 406 defined by a packaging substrate 403. For the purpose of description of FIGS. 15A-15H, it will be understood that the pocket 406 defined by the packaging substrate 403 is open at both of the upper and lower sides (e.g., similar to the example of FIG. 14E). However, it will be understood that other pocket configurations can also be utilized. It will also be understood that although described in the context of packaging GDT devices, one or more features associated with FIGS. 15A-15J can also be implemented to package and electrically connect other types of devices described herein.

In FIG. 15A, the GDT device 410 is shown to include the upper and lower electrodes 412*a*, 412*b* positioned above and below a ceramic insulator structure 414 having one more features as described herein.

FIG. 15B shows an example configuration 520 where a conductive feature 522*a* can be formed or positioned above the upper electrode 412*a* so as to extend laterally away from the center of the upper electrode 412*a*. Similarly, a conductive feature 522*b* can be formed or positioned below the lower electrode 412*b* so as to extend laterally away from the center of the upper electrode 412*b*. In the example shown, the upper conductive feature 522*a* is shown to extend to the right side away from the center, and the lower conductive feature 522*b* is shown to extend to the left side away from the center. Although described in the context of the conductive features 522*a*, 522*b* being above and below their respective electrodes, it will be understood that at least some portions of the conductive features (522*a*, 522*b*) can overlap along the vertical direction (in FIG. 15B) with their respective electrodes.

For example, FIG. 15B' shows an example configuration 520' where an upper conductive feature 522*a*' is depicted as a lateral extension of an upper electrode 412*a*'. Such a lateral extension can be, for example, a conductive tab that extends laterally outward from the right edge of the upper electrode 412*a*'. Similarly, a lower conductive feature 522*b*' is depicted as a lateral extension of a lower electrode 412*b*'. Such a lateral extension can be, for example, a conductive tab that extends laterally outward from the left edge of the lower electrode 412*b*'. In some embodiments, the each of the conductive tabs 522*a*', 522*b*' can be attached to its respective electrode 412*a*', 412*b*'. In some embodiments, each of the conductive tabs 522*a*', 522*b*' can be an integral part of the respective electrode 412*a*', 412*b*'. In the example of FIG. 15B', the packaging substrate 403' can be dimensioned so as to accommodate the laterally extending conductive tabs 522*a*', 522*b*'.

In the context of the example of FIG. 15B, each of the conductive features 522*a*, 522*b* can include, for example, a plated or brazed metal layer, a tab protruding from the side of the electrode, or a strip welded, brazed or plated to its respective electrode (412*a* or 412*b*). Other metal structures, as well as methods of connecting to the electrode, are also possible.

FIG. 15C shows a plan view of an example configuration 530 where the conductive features 522*a*, 522*b* of FIG. 15B can be applied to upper and lower sides of an array of GDT devices positioned in the packaging substrate 403. In some embodiments, alternating patterns of upper conductive features 522*a* and lower conductive features 522*b* can be implemented as shown.

FIG. 15D shows an example stage 540 where upper and lower insulation layers 422*a*, 422*b* can be formed or laminated together with metal foil layers 542*a*, 542*b* respectively above and under the respective electrode/conductive feature assembly. In some embodiments, each of the metal foil layers can include copper. Other metals can also be utilized.

FIG. 15E shows an example stage 550 where through-device vias 552 can be formed on both sides of the embedded GDT device. The via 552 on the left side is shown to extend through the upper metal foil layer 542*a*, the upper insulation layer 422*a*, the packaging substrate 403, the lower conductive feature 522*b*, the lower insulation layer 422*b*, and the lower metal foil layer 542*b*. Similarly, the via 552 on the right side is shown to extend through the upper metal foil layer 542*a*, the upper insulation layer 422*a*, the upper conductive feature 522*a*, the packaging substrate 403, the lower insulation layer 422*b*, and the lower metal foil layer 542*b*. In some implementations, such through-device vias can be formed by the example methods disclosed herein.

In some situations, the foregoing through-device vias 552 can be formed and plated easier than the partial-depth vias 424, 432 of FIG. 14E. Accordingly, such partial-depth via formation (e.g., by blind-drill operation) can be removed from the packaging process, thereby saving time and cost.

In some embodiments, the foregoing through-device vias 552 can be formed at or near locations where cuts will be made to singulate the packaged devices. For example, the vias 552 on the left and right sides (in FIG. 15E) are shown to be formed at respective lateral locations indicated by lines 554.

FIG. 15F shows a plan view of an example configuration 560 where the through-device vias 552 can be formed along device-boundary lines 554. As shown, each of the through-device vias 552 can yield a half-circle recess when the devices are cut along the boundary lines 554. Such singulation can be achieved by methods described herein.

FIG. 15G shows an example configuration 570 where the upper and lower surfaces of the assembly 550 of FIG. 15E, as well as the formed vias 552 can be metalized (e.g., plated) so as to yield an upper plated layer 574*a*, a lower plated layer 574*b*, and plated vias 572. By way of an example, such plating can include formation of a copper layer, followed by a nickel layer, followed by a gold layer. Thus, in the context of the example copper foil layers 542*a*, 542*b* of FIGS. 15D and 15E, each of the upper and lower plated layers 574*a*, 574*b* can include the plated copper layer formed over the copper foil layer, the nickel layer formed over the plated copper layer, and the gold layer formed over the plated nickel layer. It will be understood that other metallization techniques can also be utilized.

FIG. 15H shows a stage 580 where portions of the plated layers 574*a*, 574*b* can be removed (e.g., by etching) so as to electrically separate the left and right conductive vias 572. For the upper plated layer 574*a*, a region 584*a* between the two conductive vias 572 can be etched away (including the upper metal foil layer) so as to yield conductive portions (extending inward from the vias 572) that will become terminals upon singulation. For the lower plated layer 574*b*, a region 584*b* between the two conductive vias 572 can be etched away (including the upper metal foil layer) so as to yield conductive portions (extending inward from the vias 572) that will become terminals upon singulation.

In some implementations, the assembly 580 of FIG. 15H can undergo a singulation process to yield a plurality of individual units. Each individual unit (e.g., 500 in FIGS. 15I and 15J) can include a generally half-circle recess that is plated (when viewed in a plan view such as in FIG. 15J) on each of the left and right sides.

FIG. 15I shows a side sectional view of the packaged GDT device 500, and FIG. 15J shows a plan view of the same. In some implementations, terminals 592*a*, 592*b* on the left side and terminals 594*a*, 594*b* on the right side can result from the etching process described in reference to FIG. 15H. The terminals 592*a* and 592*b* are electrically connected by the conductive half-circle recess 582. Similarly, the terminals 594*a* and 594*b* are electrically connected by the conductive half-circle recess 584. Accordingly, the upper electrode 412*a* is electrically connected to the terminals 594*a*, 594*b* on the right side through the upper conductive feature 522*a* and the conductive half-circle recess 584. Similarly, the lower electrode 412*b* is electrically connected to the terminals 592*a*, 592*b* on the left side through the lower conductive feature 522*b* and the conductive half-circle recess 582.

Other techniques understood in the art can also be utilized to form the terminals 592*a*, 592*b* and 594*a*, 594*b* and their electrical connections to their respective conductive features.

As seen in FIGS. 15I and 15J, the example configuration of the terminals 592*a*, 592*b* and 594*a*, 594*b* and their electrical connections to the respective electrodes 412*b*, 412*a* yields a package device that can be insensitive to mounting orientation. For example, the example device can function substantially the same regardless of change in left-right orientation and/or up-down orientation.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." The word "coupled", as generally used herein, refers to two or more elements that may be either directly connected, or connected by way of one or more intermediate elements. Additionally, the words "herein," "above," "below," and words of similar import, when used in this application, shall refer to this application as a whole and not to any particular portions of this application. Where the context permits, words in the above Detailed Description using the singular or plural number may also include the plural or singular number respectively. The word "or" in reference to a list of two or more items, that word covers all of the following interpretations of the word: any of the items in the list, all of the items in the list, and any combination of the items in the list.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while processes or blocks are presented in a given order, alternative embodiments may perform routines having steps, or employ systems having blocks, in a different order, and some processes or blocks may be deleted, moved, added, subdivided, combined, and/or modified. Each of these processes or blocks may be implemented in a variety of different ways. Also, while processes or blocks are at times shown as being performed in series, these processes or blocks may instead be performed in parallel, or may be performed at different times.

The teachings of the invention provided herein can be applied to other systems, not necessarily the system described above. The elements and acts of the various embodiments described above can be combined to provide further embodiments.

While some embodiments of the inventions have been described, these embodiments have been presented by way of example only, and are not intended to limit the scope of the disclosure. Indeed, the novel methods and systems described herein may be embodied in a variety of other forms; furthermore, various omissions, substitutions and changes in the form of the methods and systems described herein may be made without departing from the spirit of the disclosure. The accompanying claims and their equivalents are intended to cover such forms or modifications as would fall within the scope and spirit of the disclosure.

What is claimed is:

1. An assembly of gas discharge tube (GDT) devices, the assembly comprising:

an insulator plate having first and second sides and defining a plurality of openings, the insulator plate including a plurality of score lines on either or both of the first and second sides, the score lines dimensioned to facilitate singulation of the insulation plate into a plurality of individual units each having one or more of the plurality of openings; and an electrode implemented for each of the plurality of openings on each of the first and second sides of the insulator plate so as to define an enclosed gas volume associated with each of the plurality of openings.

2. The device of claim 1, wherein the insulator plate includes a ceramic plate.

3. The device of claim 1, further comprising a joint layer disposed between each of the first and second electrodes and their respective surfaces on the first and second sides.

4. The device of claim 3, wherein the joint layer includes a metallization layer formed around each of the openings on the first and second sides of the ceramic plate.

5. The device of claim 4, wherein the joint layer further includes a brazing layer configured to facilitate joining of the electrode to the metallization layer.

6. The device of claim 1, wherein the insulator plate has a substantially uniform thickness between the first and second sides.

7. The device of claim 6, wherein each of at least some of the electrodes includes an inner center surface such that the corresponding enclosed gas volume includes a cylindrical shaped volume defined by the opening and the inner center surfaces of the corresponding electrodes.

8. The device of claim 7, wherein each of the at least some of the electrodes further includes an inner recessed portion configured to allow a portion of the corresponding surface about the opening to be exposed to the cylindrical shaped volume.

9. The device of claim 8, further comprising one or more pre-ionization lines implemented on the surface about the opening exposed by the inner recessed portion of the electrode.

10. The device of claim 1, wherein the insulator plate defines an internal insulator ring having an inner boundary defined by the corresponding opening and an outer boundary, the internal insulator ring having a reduced thickness between the inner and outer boundaries, the reduced thickness having a value that is less than a thickness between the first and second sides.

11. The device of claim 10, wherein each of at least some of the electrodes has a circular shape with an inner side and an outer side, the inner side defining a shape dimensioned to accommodate the reduced thickness of the internal insulator ring of the insulator plate.

12. The device of claim 11, further comprising one or more pre-ionization lines implemented on either or both sides of the internal insulator ring.

13. A method for fabricating gas discharge tube (GDT) devices, the method comprising:

providing or forming an insulator plate having a first side and a second side;

forming a plurality of openings on the insulator plate;

forming a plurality of score lines on either or both of the first and second sides of the insulator plate, the score lines dimensioned to facilitate singulation of the insulator plate into a plurality of individual units each having one or more openings; and covering each opening with first and second electrodes on the first and second sides of the insulator plate to thereby define an enclosed gas volume.

14. The method of claim 13, further comprising singulating the insulator plate into the plurality of individual units.

15. The method of claim 13, further comprising forming or providing a joint layer that facilitates the covering of the openings with their respective electrodes.

16. A packaged electrical device comprising:

a packaging substrate that defines a recess;

a gas discharge tube (GDT) positioned at least partially within the recess, the GDT including an insulator layer having first and second sides defining an opening, the GDT further including first and second electrodes disposed on the first and second sides of the insulator layer, respectively, so as to cover the opening to thereby define an enclosed gas volume;

first and second insulator layers positioned on first and second sides of the GDT so as to at least partially cover the first and second electrodes, respectively;

first and second terminals, each of the first and second terminals disposed on either or both of the first and second insulator layers; and a first electrical connection implemented to electrically connect the first electrode to the first terminal, and a second electrical connection implemented to electrically connect the second electrode to the second terminal, each of the first and second electrical connections including a conductive feature that extends laterally from the corresponding electrode and a conductive via that electrically connects the conductive feature and the corresponding terminal.

17. The device of claim 16, wherein each of the first and second terminals includes metal layers formed on each of the first and second insulator layers and electrically connected to each other.

18. The device of claim 17, wherein the metal layers on the first and second insulator layers for each terminal are electrically connected by the corresponding conductive via.

19. The device of claim 18, wherein the conductive via has a half-circle cross-sectional shape resulting from singulation of the packaged electrical device from another packaged electrical device.

20. The device of claim 16, wherein each of the first conductive feature and the second conductive feature is attached to or is an extension of the respective electrode when a plurality of the packaged electrical device are being fabricated in an array.

* * * * *